US009301591B2

(12) United States Patent
King

(10) Patent No.: US 9,301,591 B2
(45) Date of Patent: Apr. 5, 2016

(54) DUAL END LIQUID APPLICATOR

(71) Applicant: Sheherazade Sohrabpour King, Fairfax, CA (US)

(72) Inventor: Sheherazade Sohrabpour King, Fairfax, CA (US)

( * ) Notice: Subject to any disclaimer, the term of this patent is extended or adjusted under 35 U.S.C. 154(b) by 83 days.

(21) Appl. No.: 13/926,092

(22) Filed: Jun. 25, 2013

(65) Prior Publication Data

US 2013/0344254 A1 Dec. 26, 2013

Related U.S. Application Data

(60) Provisional application No. 61/664,179, filed on Jun. 26, 2012.

(51) Int. Cl.

| | |
|---|---|
| ***A45D 40/26*** | (2006.01) |
| ***B05D 1/28*** | (2006.01) |
| ***B05C 1/00*** | (2006.01) |
| ***A45D 34/04*** | (2006.01) |

(52) U.S. Cl.

CPC ..... *A45D 40/261* (2013.01); *A45D 34/041* (2013.01); *B05C 1/00* (2013.01); *B05D 1/28* (2013.01)

(58) Field of Classification Search

CPC ... A45D 34/041; A45D 34/04; A45D 40/261; B43K 27/08; B43M 11/02; B05C 17/02; B05C 17/0205; B05C 17/0227; B05C 17/03

USPC ..... 401/16, 17, 21, 34, 44–47, 183, 208, 401/209, 213

See application file for complete search history.

(56) References Cited

U.S. PATENT DOCUMENTS

| | | | | |
|---|---|---|---|---|
| 3,025,834 | A * | 3/1962 | Aaron | 401/34 |
| 4,529,329 | A * | 7/1985 | Hirabayashi et al. | 401/209 |
| 5,269,037 | A | 12/1993 | White | |
| 5,493,749 | A | 2/1996 | Zayas | |
| D410,110 | S | 5/1999 | Roland | |
| 6,247,865 | B1 * | 6/2001 | Russell et al. | 401/213 |
| 6,371,675 | B1 | 4/2002 | Hoang et al. | |
| D514,744 | S | 2/2006 | Angeletta | |
| 7,153,053 | B1 * | 12/2006 | Wiley | 401/219 |
| 7,637,679 | B2 | 12/2009 | May et al. | |
| 7,851,419 | B2 | 12/2010 | Ahmed et al. | |
| 2005/0169693 | A1 * | 8/2005 | Serio et al. | 401/219 |
| 2009/0269121 | A1 | 10/2009 | Snedden et al. | |
| 2010/0166489 | A1 * | 7/2010 | Rossi Neto et al. | 401/209 |

* cited by examiner

*Primary Examiner* — David Walczak
*Assistant Examiner* — Bradley Oliver
(74) *Attorney, Agent, or Firm* — Ash Tankha; Liston, Weinberger & Husick

(57) ABSTRACT

A dual end liquid applicator including a reservoir handle having a first opening defined at a first end, a second opening defined at a second end opposing the first end, a first head member, and a second head member is provided. The reservoir handle defines an internal cavity for storing a dispensing liquid. The first head member is operably connected at the first opening at the first end of the reservoir handle. The second head member is operably connected at the second opening at the second end of the reservoir handle. The first head member and the second head member, when rolled over a contact surface, transfer and dispense the dispensing liquid from the internal cavity of the reservoir handle through the first opening at the first end of the reservoir handle and the second opening at the second end of the reservoir handle respectively, to the contact surface.

6 Claims, 25 Drawing Sheets

DUAL END LIQUID APPLICATOR

CROSS REFERENCE TO RELATED APPLICATIONS

This application claims the benefit of provisional patent application No. 61/664,179 titled "Dual End Liquid Applicator", filed in the United States Patent and Trademark Office on Jun. 26, 2012.

The specification of the above referenced patent application is incorporated herein by reference in its entirety.

BACKGROUND

A liquid applicator is a device typically used to dispense a liquid on a surface with which a dispensing surface of the liquid applicator comes in contact with, herein referred to as a "contact surface". Liquid applicators find applications in various fields, for example, cosmetics, architectural applications, design applications, culinary applications, bakery, etc. Liquid applicators are typically used in the cosmetic industry for applying cosmetics, for example, body lotions, cold creams, body oils, face wash, etc., to a contact surface, for example, skin of a female body part or a male body part. Liquid applicators allow controlled dispensing of liquids from a container to the contact surface, for example, in the cosmetic industry. However, typical liquid applicators are dedicated for use by only female users or by male users and typically do not find an application by both users. The difference in the use of the liquid applicator depends on the difference in the type of liquid required, amount of the liquid required, and the contour of the surface on which the liquid is to be dispensed. There is a need for a single liquid applicator that satisfies the requirement of both female and male users, for example, for personal lubrication on various body parts.

Hence, there is a long felt but unresolved need for a personalized dual end liquid applicator configured for application of one or more dispensing liquids, for example, a lubricant on contact surfaces such as private body parts for different users, where one end of the dual end liquid applicator is configured for a female user and the other end of the dual end liquid applicator is configured for a male user. Furthermore, there is a need for a single dual end liquid applicator that dispenses different types of dispensing liquids through different ends of the liquid applicator.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The apparatus and method of use disclosed herein address the above mentioned need for a personalized dual end liquid applicator configured for application of one or more dispensing liquids, for example, a lubricant on contact surfaces, with one end of the dual end liquid applicator configured for use on male body surfaces and the other end of the dual end liquid applicator configured for use on female body surfaces. As used herein, the term "contact surface" refers to any part such as skin or a surface of the body of a male user or a female user, or any other surface intended for application of a dispensing liquid. The dual end liquid applicator also dispenses different types of dispensing liquids through different ends of the dual end liquid applicator. The dual end liquid applicator disclosed herein comprises a reservoir handle, a first head member, and a second head member. The reservoir handle comprises a first end and a second end. The second end of the reservoir handle opposes the first end of the reservoir handle. The reservoir handle further comprises a first opening defined at the first end of the reservoir handle, and a second opening defined at the second end of the reservoir handle. The first head member and the second head member are operably connected on the first end and the second end of the reservoir handle respectively. The reservoir handle contains a dispensing liquid, for example, a viscous lubricant. The reservoir handle defines an internal cavity configured to store the dispensing liquid. In an embodiment, the dual end liquid applicator disclosed herein further comprises one or more reservoirs defined in the internal cavity of the reservoir handle. The reservoirs are configured to store one dispensing liquid or different dispensing liquids, one dispensing liquid for the first end and one dispensing liquid for the second end. In an embodiment, the dual end liquid applicator disclosed herein further comprises gripping sections defined on the opposing sides of the reservoir handle. The gripping sections are configured for application of pressure by a user for dispensing the dispensing liquid from the internal cavity of the reservoir handle through the first opening defined at the first end of the reservoir handle or the second opening defined at the second end of the reservoir handle. The gripping sections are made of a flexible, deformable material configured to regain their original shape, when the pressure applied to the gripping sections of the reservoir handle by the user is removed. In an embodiment, the reservoir handle is also made of a flexible, deformable material configured to regain its original shape.

The first head member of the dual end liquid applicator disclosed herein is operably connected at the first opening defined at the first end of the reservoir handle. In an embodiment, the first head member is configured to house a roller ball assembly. The roller ball assembly is configured to transfer and dispense the dispensing liquid from the internal cavity of the reservoir handle through the first opening defined at the first end of the reservoir handle to a contact surface, for example, a female body part or another contact surface, when the first head member is rolled over and in contact with the contact surface. The roller ball assembly disclosed herein comprises a roller ball and a ball lock ring. The roller ball is rollably positioned within a hemispherical housing defined proximal to the first opening at the first end of the reservoir handle. The roller ball is configured to contact and to be coated with the dispensing liquid stored in the internal cavity of the reservoir handle and to roll within the hemispherical housing, when the roller ball is rolled over and in contact with the contact surface. The ball lock ring of the roller ball assembly is attached to the first end of the reservoir handle. The ball lock ring is configured to slidably lock the roller ball within the hemispherical housing defined proximal to the first opening at the first end of the reservoir handle. In an embodiment, the dual end liquid applicator disclosed herein further comprises a flippable lid hingedly connected to the first end of the reservoir handle for covering the first head member, for example, when the first head member is not in use. The flippable lid is configured to be opened and closed by a user with a single hand for exposing and concealing the first head member respectively. In an embodiment, the dual end liquid applicator disclosed herein further comprises a cradle defined below the first end of the reservoir handle and proximal to the first head member. The cradle is configured to retain the flippable lid in an open position.

The second head member of the dual end liquid applicator disclosed herein is operably connected at the second opening defined at the second end of the reservoir handle. In an embodiment, the second head member is configured to house an elongate roller assembly. The elongate roller assembly is configured to transfer and dispense the dispensing liquid from the internal cavity of the reservoir handle through the second opening defined at the second end of the reservoir handle to a contact surface, for example, a male body part or another contact surface, when the second head member is rolled over and in contact with the contact surface. The elongate roller assembly disclosed herein comprises an elongated roller and a roller lock ring. The elongated roller is rotatable about a horizontal longitudinal axis of the elongated roller. The elongated roller is rollably positioned within an elongate housing defined proximal to the second opening at the second end of the reservoir handle. The elongated roller is configured to contact and to be coated with the dispensing liquid stored in the internal cavity of the reservoir handle and to roll within the elongate housing, when the elongated roller is rolled over and in contact with the contact surface. The roller lock ring is attached to the second end of the reservoir handle. The roller lock ring is configured to slidably lock the elongated roller within the elongate housing. In an embodiment, the dual end liquid applicator disclosed herein further comprises a flippable lid hingedly connected to the second end of the reservoir handle for covering the second head member, for example, when the second head member is not in use. The flippable lid is configured to be opened and closed by a user with a single hand for exposing and concealing the second head member respectively. In an embodiment, the dual end liquid applicator disclosed herein further comprises a cradle defined above the second end of the reservoir handle and proximal to the second head member. The cradle is configured to retain the flippable lid in an open position.

In an embodiment, the dual end liquid applicator further comprises a liquid dispenser system operably connected in the internal cavity of the reservoir handle. The liquid dispenser system comprises at least two elongate reservoirs, a first outlet pipe, second outlet pipes, and a liquid transfer assembly. The elongate reservoirs are positioned substantially parallel to each other within the internal cavity of the reservoir handle. A first elongate reservoir is configured to store a first dispensing liquid. A second elongate reservoir is configured to store a second dispensing liquid. The second dispensing liquid could be different from the first dispensing liquid or the same as the first dispensing liquid. The first outlet pipe extends from each of the opposing ends of each of the elongate reservoirs. The first outlet pipe is in fluid communication with each of the elongate reservoirs. The first outlet pipe of the first elongate reservoir is configured to transfer and dispense the first dispensing liquid from the first elongate reservoir to an outlet hole proximal to each of the first end and the second end of the reservoir handle. The first outlet pipe of the second elongate reservoir is configured to transfer and dispense the second dispensing liquid from the second elongate reservoir to the outlet hole proximal to each of the first end and the second end of the reservoir handle.

The second outlet pipes of the liquid dispenser system extend from the opposing ends of the elongate reservoirs. The second outlet pipes are in fluid communication with the elongate reservoirs. In an embodiment, the second outlet pipes of the two elongate reservoirs are fused to create a mixer outlet pipe. The mixer outlet pipe is configured to transfer and dispense a combination of the first dispensing liquid and the second dispensing liquid from the elongate reservoirs to the outlet hole proximal to each of the first end and the second end of the reservoir handle. The liquid transfer assembly is operably connected to each of the first end and the second end of the reservoir handle. The liquid transfer assembly comprises a flexible disc and a transfer pipe. The flexible disc defines a hole proximal to an inner circumference of the flexible disc and is in fluid communication with the outlet hole. The transfer pipe is fixedly attached to the hole on an upper surface of the flexible disc. The flexible disc is rotatable to alternatively connect the hole of the flexible disc to the first outlet pipe of each of the elongate reservoirs or to the mixer outlet pipe, and transfer and dispense the first dispensing liquid, the second dispensing liquid, or a combination thereof to the outlet hole proximal to the first end of the reservoir handle or the outlet hole proximal to the second end of the reservoir handle via the transfer pipe, when pressure is applied on the reservoir handle. In an embodiment, the liquid transfer assembly further comprises a sleeve defined along the inner circumference of the flexible disc. The sleeve is configured to slidably engage with a portion of the reservoir handle internally for enabling rotation of the flexible disc.

When a user holds the dual end liquid applicator in a substantially vertical position and moves the dual end liquid applicator over and in contact with a contact surface, with the first head member or the second head member in contact with the contact surface, and applies a pressure at the gripping sections of the dual end liquid applicator, the dispensing liquid flows in a downward direction and coats the surface of the first head member or the second head member. The dispensing liquid is thereafter transferred from the coated first head member or the second head member to the contact surface, when the user rolls the first head member or the second head member over and in contact with the contact surface. The first head member and the second head member are therefore configured to transfer and dispense the dispensing liquid from the internal cavity of the reservoir handle through the first opening defined at the first end of the reservoir handle and the second opening defined at the second end of the reservoir handle to a contact surface, for example, a male body part, a female body part, or any other contact surface.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and components disclosed herein.

DETAILED DESCRIPTION OF THE INVENTION

Figure 1A:
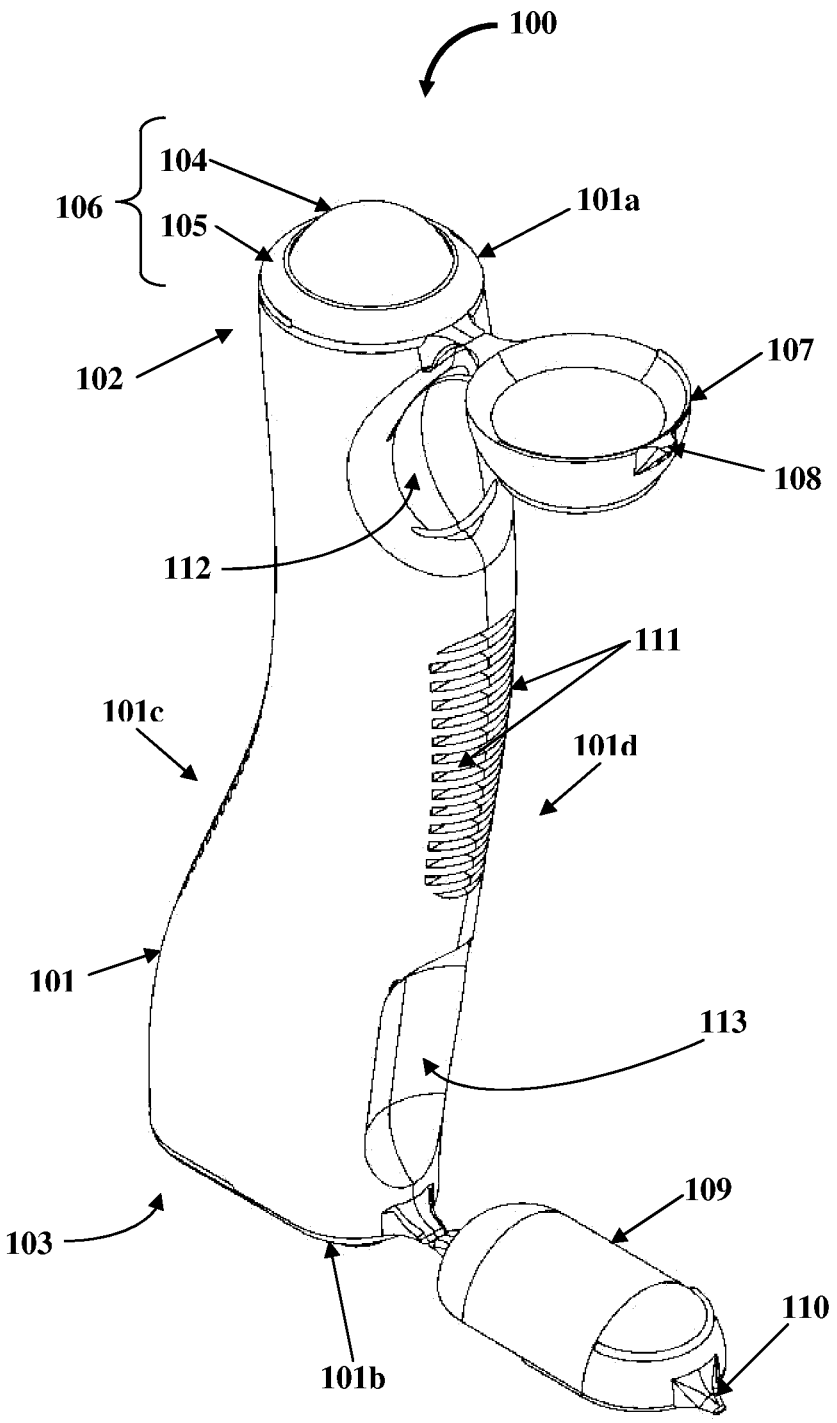
FIG. 1A exemplarily illustrates an isometric view of a dual end liquid applicator, showing flippable lids of the dual end liquid applicator in an open position.

FIG. 1A exemplarily illustrates an isometric view of a dual end liquid applicator 100, showing flippable lids 107 and 109 of the dual end liquid applicator 100 in an open position. The dual end liquid applicator 100 disclosed herein is fabricated of materials such as plastics, ceramics, metals, etc. The body volume of the dual end liquid applicator 100 is, for example, about 1.96 cubic inches. The total weight of the dual end liquid applicator 100 is, for example, about 0.088 pounds or about 40 grams. The length of the dual end liquid applicator 100 is, for example, about 5.58 inches. The dual end liquid applicator 100 disclosed herein comprises a reservoir handle 101 having a first end 101*a* and a second end 101*b*. The second end 101*b* of the reservoir handle 101 opposes the first end 101*a* of the reservoir handle 101. The width of the dual end liquid applicator 100 tapers, for example, from about 1.50 inches at the second end 101*b* to about 1 inch at the first end 101*a*. The thickness of the outer wall of the reservoir handle 101 is, for example, about 0.05 inches. The reservoir handle 101 is configured with a first opening 101*e* and a second opening 101*f* as exemplarily illustrated in FIG. 2 and FIGS. 8A-8C, defined at the first end 101*a* and the second end 101*b* of the dual end liquid applicator 100 respectively. The reservoir handle 101 is configured to have a generally oblong geometry. The reservoir handle 101 is, for example, made of bio-compostable, starch based plastic. The reservoir handle 101 defines an internal cavity 114 as exemplarily illustrated in FIG. 2 and FIG. 7, configured to store a dispensing liquid 1001 as exemplarily illustrated in FIG. 10A. As used herein, the term "dispensing liquid" refers to a liquid, for example, a personal lubricant, a lotion, an oil, a liquid soap, a sunscreen, a medical ointment, etc., and any other viscous liquid or fluid that can be contained in and dispensed from the internal cavity 114 of the reservoir handle 101. The internal cavity 114 of the reservoir handle 101 has an internal volume of, for example, about 2.7 cubic inches or 1.5 ounces.

In an embodiment, the dual end liquid applicator 100 disclosed herein further comprises gripping sections 111 defined on the opposing sides 101*c* and 101*d* of the reservoir handle 101. The gripping sections 111 are configured for application of pressure in a direction shown by arrows in FIG. 10C and FIG. 10E, by a user for dispensing the dispensing liquid 1001 from the internal cavity 114 of the reservoir handle 101 through the first opening 101*e* defined at the first end 101*a* of the reservoir handle 101 and the second opening 101*f* defined at the second end 101*b* of the reservoir handle 101. The gripping sections 111 are made of a soft, flexible, pliable and readily deformable material, for example, a rubber, a polymer, etc., configured to regain their original shape when the pressure applied to the gripping sections 111 of the reservoir handle 101 is removed. The length of the gripping sections 111 vary, for example, from about 2.50 inches to about 1.50 inches. The gripping sections 111 flex on application of a pressure by a user and return to the original shape of the gripping sections 111 when the applied pressure is removed.

The dual end liquid applicator 100 including the ergonomic gripping sections 111 are made, for example, from a bio-compostable, starch based plastic. The dual end liquid applicator 100 therefore does not require recycling after the dispensing liquid 1001 contained in the internal cavity 114 of the reservoir handle 101 has been used. The dispensing liquid 1001 from the dual end liquid applicator 100 can be applied directly on a body contact surface 901 or 902 as exemplarily illustrated in FIGS. 9A-9B, such as the skin of a user or any body part and then disposed as solid waste into a compost bin after use.

As exemplarily illustrated in FIG. 1A, the dual end liquid applicator 100 disclosed herein further comprises a first head member 102 and a second head member 103. The first head member 102 and the second head member 103 are configured for extruding the dispensing liquid 1001 from the internal cavity 114 of the reservoir handle 101 via the first opening 101*e* defined at the first end 101*a* of the reservoir handle 101 and the second opening 101*f* defined at the second end 101*b* of the reservoir handle 101 respectively, and for applying the dispensing liquid 1001 to a contact surface 901 or 902, for example, a male body part of a male user or a female body part of a female user, or any other contact surface 901 or 902 as exemplarily illustrated in FIGS. 9A-9B. As used herein, the term "contact surface" refers to any part such as skin or a surface of the body of a male user or a female user, or any other surface intended for application of a dispensing liquid 1001.

The first head member 102 is operably connected at the first opening 101*e* defined at the first end 101*a* of the reservoir handle 101. In an embodiment, the first head member 102 is configured to house a roller ball assembly 106. The roller ball assembly 106 is configured to transfer and dispense the dispensing liquid 1001 from the internal cavity 114 of the reservoir handle 101 through the first opening 101*e* defined at the first end 101*a* of the reservoir handle 101 to a contact surface 901, for example, a female body part or another contact surface 901, when the first head member 102 is rolled over and in contact with the contact surface 901. The roller ball assembly 106 disclosed herein comprises a roller ball 104 and a ball lock ring 105. The roller ball 104 is rollably positioned within a hemispherical housing 118 exemplarily illustrated in FIG. 2, defined proximal to the first opening 101*e* at the first end 101*a* of the reservoir handle 101. The roller ball assembly 106 is configured to allow the roller ball 104 to rotate 360 degrees within the hemispherical housing 118 when a user rolls the roller ball 104 over and in contact with the surface of a body part. The roller ball 104, of a generally spherical shape, is configured to contact and to be coated with the dispensing liquid 1001 stored in the internal cavity 114 of the reservoir handle 101 and to roll within the hemispherical housing 118, when the roller ball 104 is rolled over and in contact with the contact surface 901. The diameter of the roller ball 104 is, for example, about 0.78 inches. The ball lock ring 105 is attached to the first end 101*a* of the reservoir handle 101. The ball lock ring 105 is configured to slidably lock the roller ball 104 within the hemispherical housing 118. The roller ball 104 rolls inside the hemispherical housing 118 to allow the dispensing liquid 1001 to coat the roller ball 104 and the dispensing liquid 1001 to be dispensed through the first head member 102, when the first head member 102 is rolled over and in contact with the contact surface 901. The second head member 103 is operably connected to the second opening 101*f* defined at the second end 101*b* of the reservoir handle 101. The second head member 103 is configured to house an elongate roller assembly 117 as exemplarily illustrated and disclosed in the detailed description of FIG. 2.

Figure 3A:
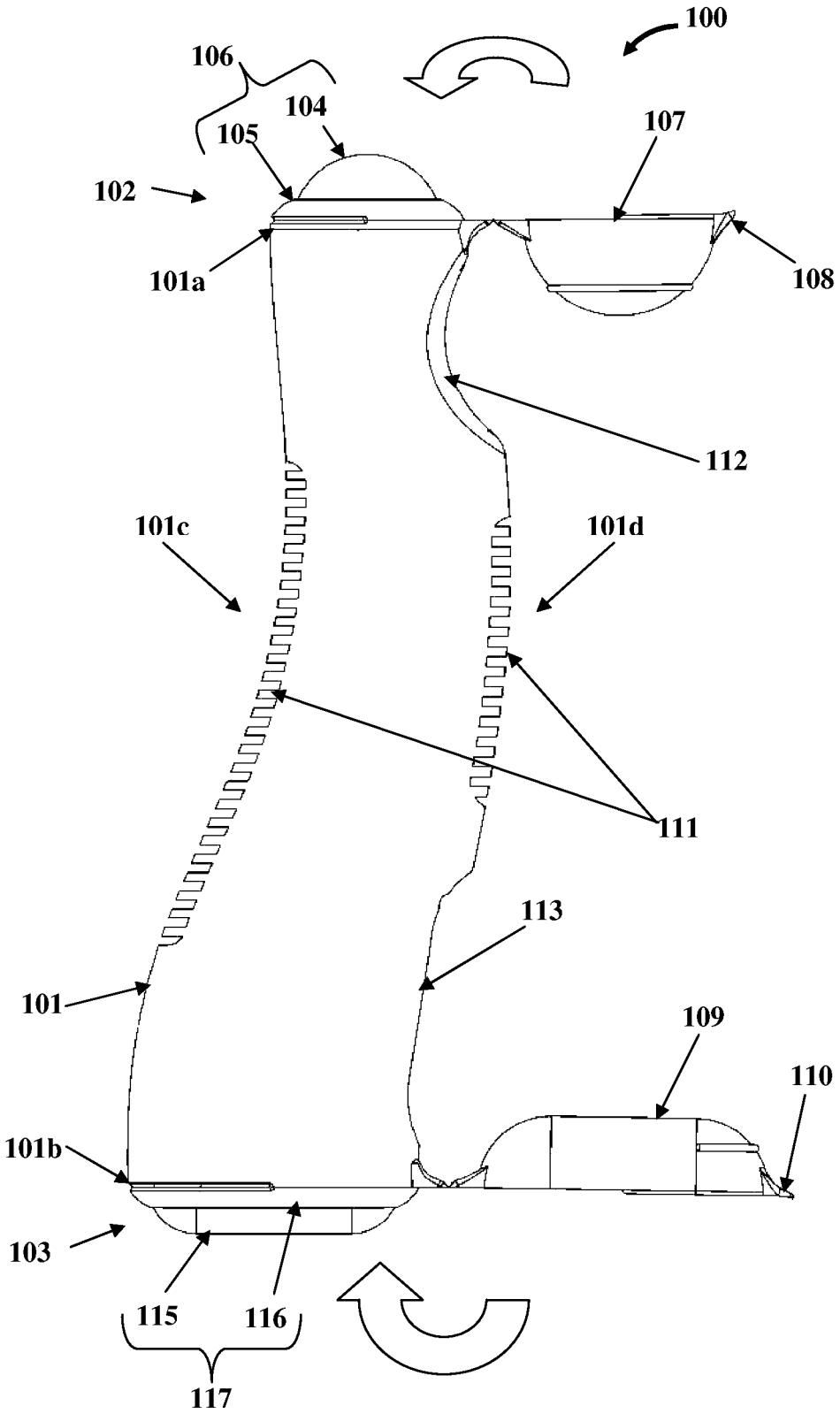
FIG. 3A exemplarily illustrates a front elevation view of the dual end liquid applicator, showing the flippable lids in an open position.
Figure 3B:
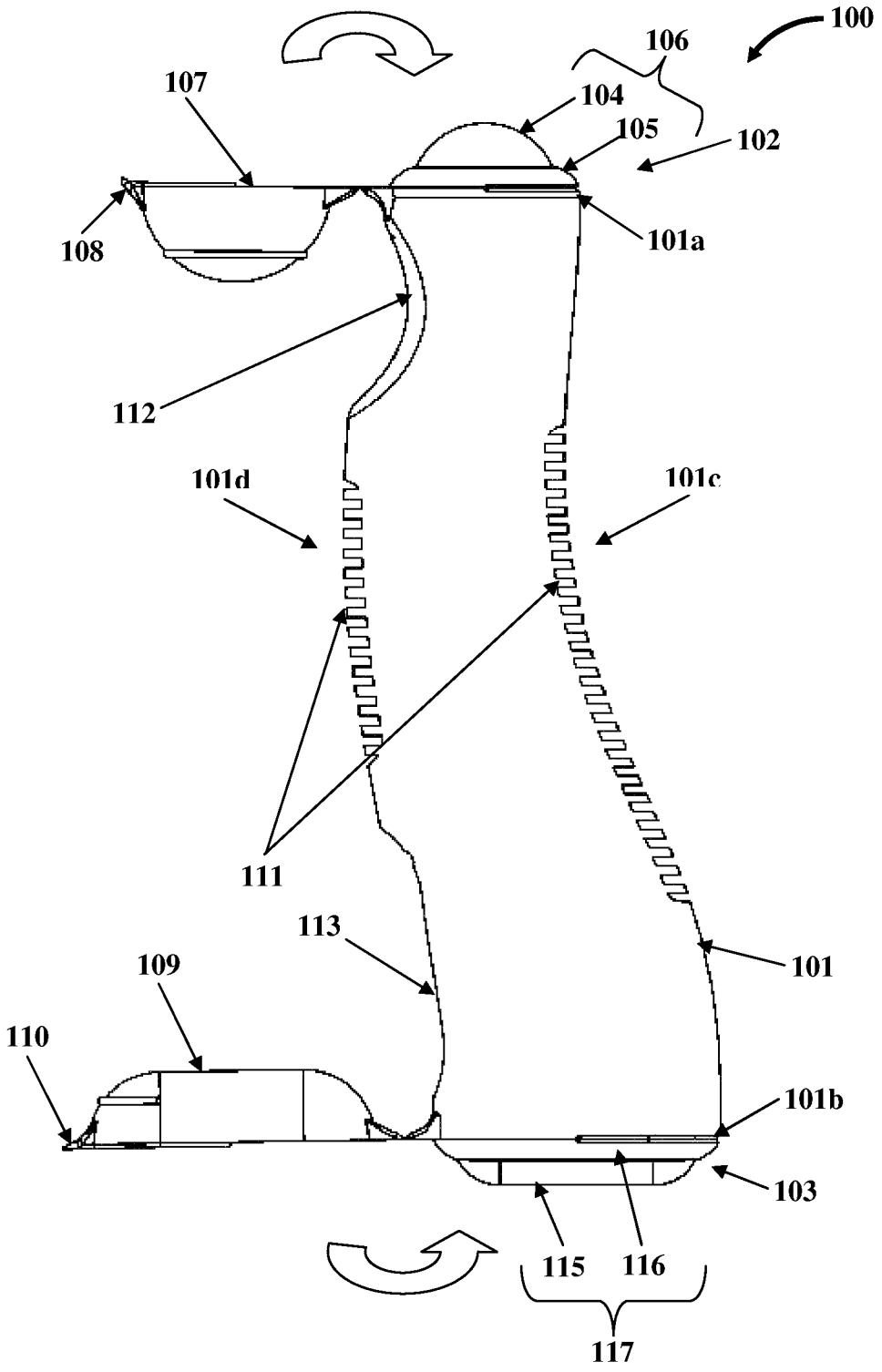
FIG. 3B exemplarily illustrates a rear elevation view of the dual end liquid applicator, showing the flippable lids in an open position.

In an embodiment, the dual end liquid applicator 100 disclosed herein further comprises flippable lids 107 and 109 with corresponding lid tabs 108 and 110 respectively, as disclosed in the detailed description of FIGS. 3A-3B. In an embodiment, the dual end liquid applicator 100 disclosed herein further comprises a cradle 112 defined below the first end 101*a* of the reservoir handle 101 and proximal to the first head member 102. In another embodiment, the dual end liquid applicator 100 disclosed herein further comprises a cradle 113 defined above the second end 101*b* of the reservoir handle 101 and proximal to the second head member 103. When the flippable lids 107 and 109 are opened to expose the first head member 102 and the second head member 103 respectively, the flippable lids 107 and 109 are retained or held in the open position by the cradles 112 and 113 respectively, as exemplarily illustrated in FIGS. 9A-9B.

Figure 1B:
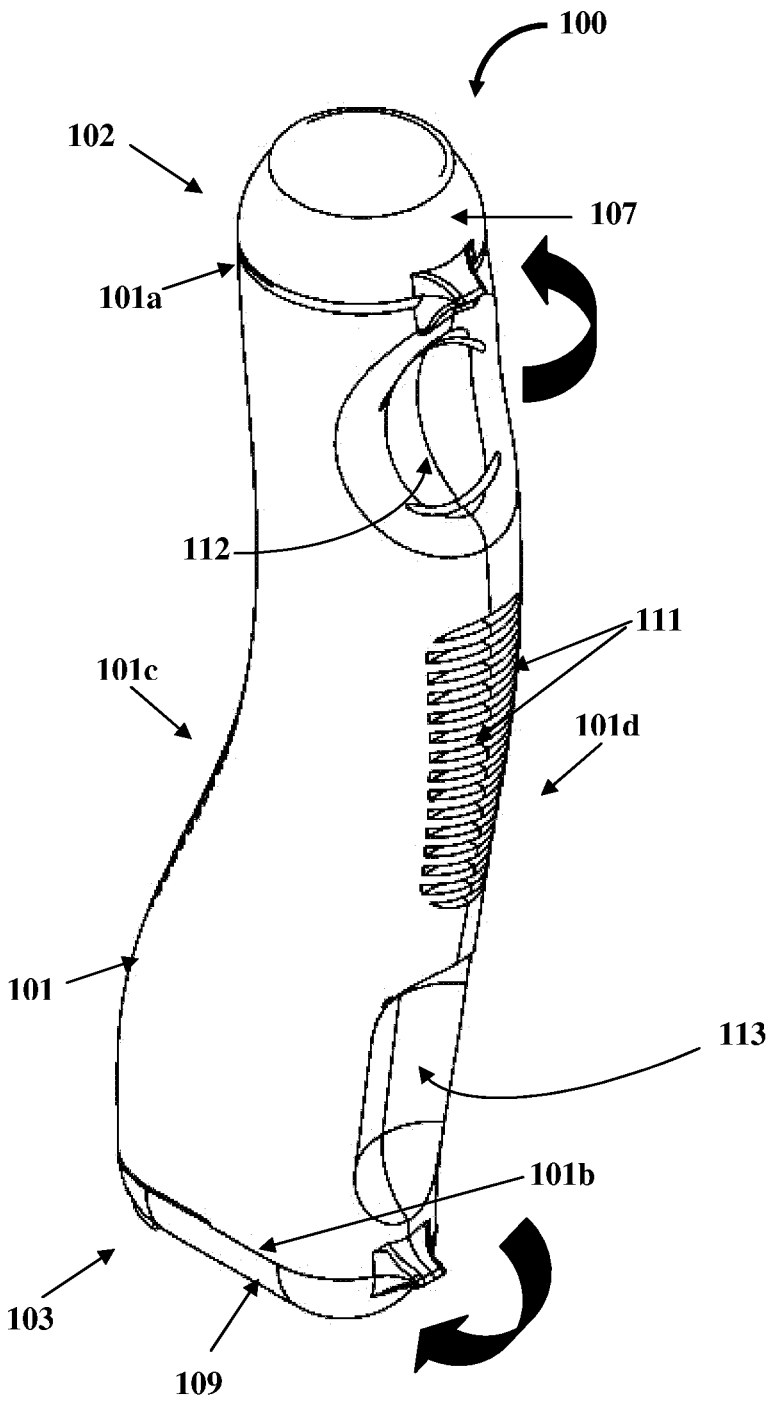
FIG. 1B exemplarily illustrates an isometric view of the dual end liquid applicator, showing flippable lids covering a first head member and a second head member of the dual end liquid applicator in a closed position.

FIG. 1B exemplarily illustrates an isometric view of the dual end liquid applicator 100, showing the flippable lids 107 and 109 covering the first head member 102 and the second head member 103 of the dual end liquid applicator 100 in a closed position. The first head member 102 and the second head member 103 are covered using the flippable lids 107 and 109 to avoid spillage of the dispensing liquid 1001 exemplarily illustrated in FIG. 10A, after the dual end liquid applicator 100 is used by a user. After usage of the dual end liquid applicator 100, the flippable lids 107 and 109 are retracted from the cradles 112 and 113 proximal to the first head member 102 and the second head member 103 respectively, to close or cover the first head member 102 and the second head member 103 respectively, as exemplarily illustrated by arrows in FIG. 1B. When the dual end liquid applicator 100 is not in use, the dual end liquid applicator 100 is stored with the flippable lids 107 and 109 covering the first head member 102 and the second head member 103 in the closed position.

Figure 2:
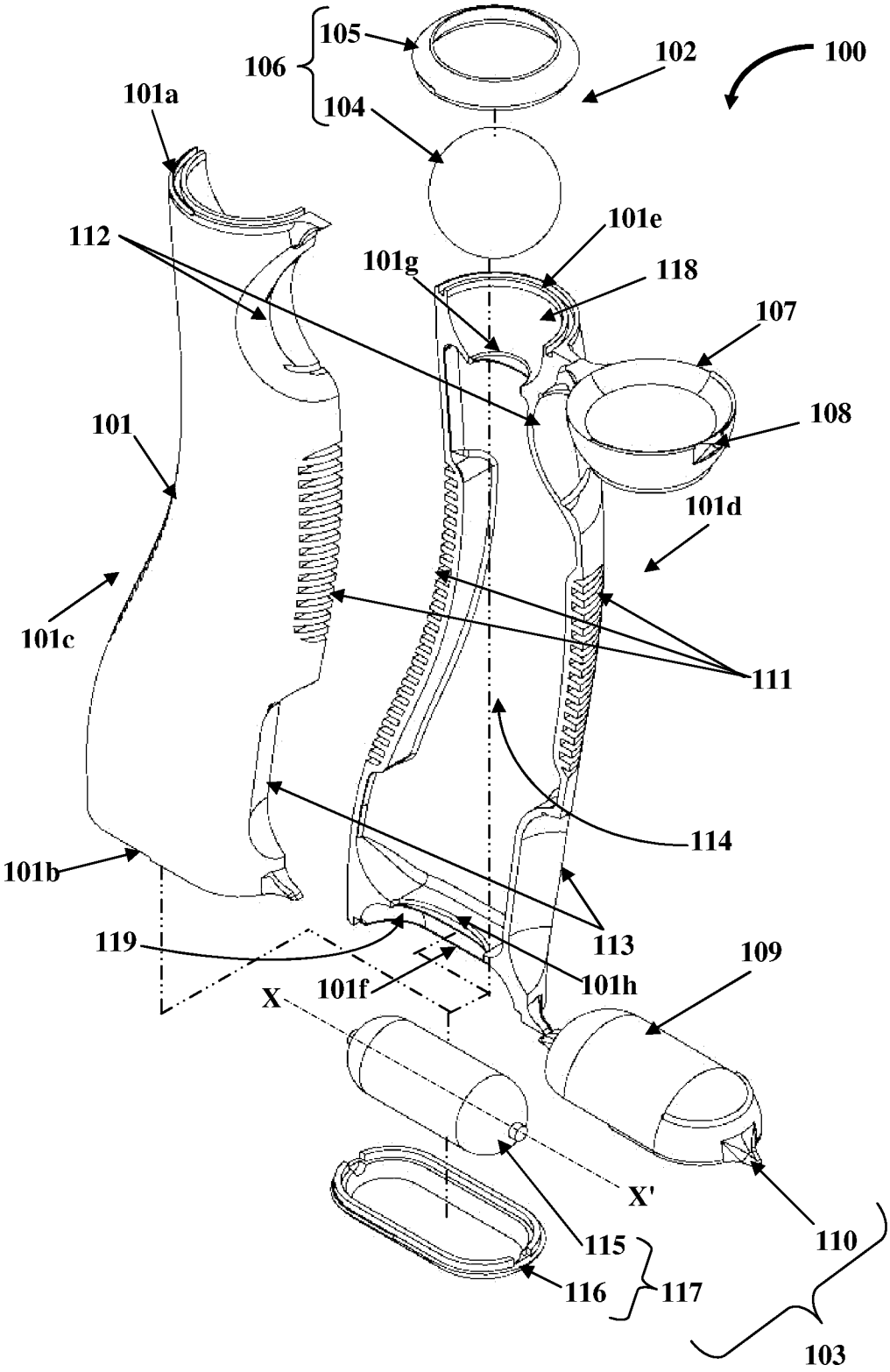
FIG. 2 exemplarily illustrates an exploded view of the dual end liquid applicator, showing an internal cavity defined in a reservoir handle of the dual end liquid applicator.

FIG. 2 exemplarily illustrates an exploded view of the dual end liquid applicator 100, showing the internal cavity 114 defined in the reservoir handle 101 of the dual end liquid applicator 100. The dual end liquid applicator 100 comprises the reservoir handle 101, the first head member 102, and the second head member 103 as disclosed in the detailed description of FIG. 1A. The internal cavity 114 has an elongate volume configured to store a dispensing liquid 1001 exemplarily illustrated in FIG. 10A. The dispensing liquid 1001 stored in the internal cavity 114 is dispensed through one or both of the first opening 101*e* and the second opening 101*f* defined at the first end 101*a* and the second end 101*b* of the reservoir handle 101 respectively. The first head member 102 operably connected at the first opening 101*e* defined at the first end 101*a*, and the second head member 103 operably connected at the second opening 101*f* defined at the second end 101*b* dispense the dispensing liquid 1001 to contact surfaces 901 and 902 as exemplarily illustrated in FIGS. 9A-9B. The hemispherical housing 118 is defined proximal to the first opening 101*e* defined at the first end 101*a* of the reservoir handle 101. The hemispherical housing 118 is configured to slidably accommodate the roller ball 104 of the roller ball assembly 106. The ball lock ring 105 locks the roller ball 104 within the hemispherical housing 118. When a user applies pressure on the gripping sections 111 of the reservoir handle 101, the dispensing liquid 1001 extrudes from the internal cavity 114 of the reservoir handle 101 through the first opening 101*e* at the first end 101*a* of the reservoir handle 101 and coats the roller ball 104. The coated roller ball 104 transfers and dispenses the dispensing liquid 1001 coated on the roller ball 104 to the user's contact surface 901, when the roller ball 104 is rolled over and in contact with the contact surface 901 as exemplarily illustrated in FIG. 9A.

The reservoir handle 101 defines an outlet hole 101*g* proximal to the first end 101*a* of the reservoir handle 101. The outlet hole 101*g* is configured to provide an outlet for the dispensing liquid 1001 to coat the roller ball 104. The radius of the outlet hole 101*g* is, for example, about 0.2 inches. The radius of the first opening 101*e* defined at the first end 101*a* where the ball lock ring 105 is to be attached is, for example, about 0.4 inches. The radius of the junction of insertion of the ball lock ring 105 is, for example, about 0.367 inches.

The second head member 103 is configured to house the elongate roller assembly 117. The elongate roller assembly 117 is configured to transfer and dispense the dispensing liquid 1001 from the internal cavity 114 of the reservoir handle 101 through the second opening 101*f* defined at the second end 101*b* of the reservoir handle 101 to a contact surface 902, for example, a male body part or another contact surface 902 as exemplarily illustrated in FIG. 9B, when the second head member 103 is rolled over and in contact with the contact surface 902. The elongate roller assembly 117 comprises an elongated roller 115 and a roller lock ring 116. The elongated roller 115 is rotatable about a horizontal longitudinal axis X-X' exemplarily illustrated in FIG. 2. The diameter of the elongated roller 115 is, for example, about 0.50 inches. The elongated roller 115 is rollably positioned within an elongate housing 119 defined proximal to the second opening 101*f* at the second end 101*b* of the reservoir handle 101. The elongate housing 119 is configured to slidably accommodate the elongated roller 115. The elongated roller 115 is configured to contact and to be coated with the dispensing liquid 1001 stored in the internal cavity 114 of the reservoir handle 101 and to roll within the elongate housing 119, when the elongated roller 115 is rolled over and in contact with the contact surface 902. The roller lock ring 116 is attached to the second end 101*b* of the reservoir handle 101. The roller lock ring 116 is configured to slidably lock the elongated roller 115 within the elongate housing 119.

The dimensions from the reservoir handle 101 towards the elongated roller 115 defining a generally oval shape are, for example, about 0.75 inches×0.27 inches. The dimensions of the second end 101*b* where the roller lock ring 116 is to be attached is, for example, about 1.3 inches×0.55 inches. The radius of the junction of insertion of the roller lock ring 116 is, for example, about 1.25 inches×0.45 inches. The elongated roller 115 having a cylindrical geometry slidably rolls on the contact surface 902, for example, a contact surface of a male body part as exemplarily illustrated in FIG. 9B. When a user applies a pressure on the gripping sections 111 of the reservoir handle 101, the dispensing liquid 1001 extrudes from the internal cavity 114 of the reservoir handle 101 through the second opening 101*f* defined at the second end 101*b* of the reservoir handle 101 and coats the elongated roller 115 of the elongate roller assembly 117. The coated elongated roller 115 transfers and dispenses the dispensing liquid 1001 coated on the elongated roller 115 to the user's contact surface 902, when the elongated roller 115 is rolled over and in contact with the contact surface 902. The elongated roller 115 rolls over the user's contact surface 902 and releases the dispensing liquid 1001 coated on the elongated roller 115 to the user's contact surface 902 as exemplarily illustrated in FIG. 9B.

FIGS. 3A-3B exemplarily illustrate a front elevation view and a rear elevation view respectively, of the dual end liquid applicator 100, showing the flippable lids 107 and 109 in an open position. In an embodiment, the flippable lid 107 is hingedly connected to the first end 101*a* of the reservoir handle 101 for covering the first head member 102, when the first head member 102 is not in use. The flippable lid 107 is hingedly connected proximal to the first head member 102. The flippable lid 107 is configured to be opened and closed by a user with a single hand in a facile manner for exposing and concealing the first head member 102 respectively. The flippable lid 107 is activated by a lid tab 108 molded on the flippable lid 107. The lid tab 108 is molded onto the flippable lid 107 to facilitate opening and closing of the flippable lid 107 for exposing and concealing the first head member 102 respectively. The flippable lid 107 snap fits with the ball lock ring 105 of the roller ball assembly 106, when closed as exemplarily illustrated in FIG. 1B. The flippable lid 107 covers the first head member 102 for preventing flow of the dispensing liquid 1001 exemplarily illustrated in FIG. 10A, through the first head member 102, when the first head member 102 is not in use. The cradle 112 is configured to retain or hold the flippable lid 107 in an open position as exemplarily illustrated in FIG. 9A.

In another embodiment as exemplarily illustrated in FIG. 3B, another flippable lid 109 is hingedly connected to the second end 101*b* of the reservoir handle 101 for covering the second head member 103, for example, when the second head member 103 is not in use. The flippable lid 109 is hingedly connected proximal to the second head member 103. The flippable lid 109 is configured to be opened and closed by a user with a single hand in a facile manner for exposing and concealing the second head member 103 respectively. The flippable lid 109 is activated by a lid tab 110 molded on the flippable lid 109. The lid tab 110 is molded onto the flippable lid 109 to facilitate opening and closing of the flippable lid 109 for exposing and concealing the second head member 103 respectively. The flippable lid 109 snap fits with the roller lock ring 116 of the elongate roller assembly 117, when closed as exemplarily illustrated in FIG. 1B and FIG. 9A. The flippable lid 109 covers the second head member 103 for preventing flow of the dispensing liquid 1001 through the second head member 103, when the second head member 103 is not in use. The cradle 113 is configured to retain or hold the flippable lid 109 in an open position as exemplarily illustrated in FIG. 9B.

The flippable lid 107 opens outwardly to fit into the cradle 112, while the flippable lid 109 opens outwardly to fit into the cradle 113. The cradles 112 and 113 define ergonomic divot grips for securely holding the flippable lids 107 and 109. The dual end liquid applicator 100 prevents the dispensing liquid 1001 content from spilling with simplified, easily flippable, single hand operated flippable lids 107 and 109. The flippable lids 107 and 109 of the single hand held dual end liquid applicator 100 are configured, for example, as flip caps for quick open and closure. The user can quickly flick a finger to open the flippable lid 107 or 109 to dispense the dispensing liquid 1001, for example, lotion, gel, etc., contained in the internal cavity 114 of the reservoir handle 101 exemplarily illustrated in FIG. 2, FIG. 7, and FIG. 10A. The user can open the flippable lids 107 and 109 to distribute the dispensing liquid 1001, for example, a viscous fluid upon contact with the user's skin or any other surface 901 or 902 exemplarily illustrated in FIGS. 9A-9B, over which the dual end liquid applicator 100 glides. The cradles 112 and 113 are configured, for example, as concave cap rests to support a user's thumb while gripping the dual end liquid applicator 100 and dispensing the dispensing liquid 1001.

Figure 4:
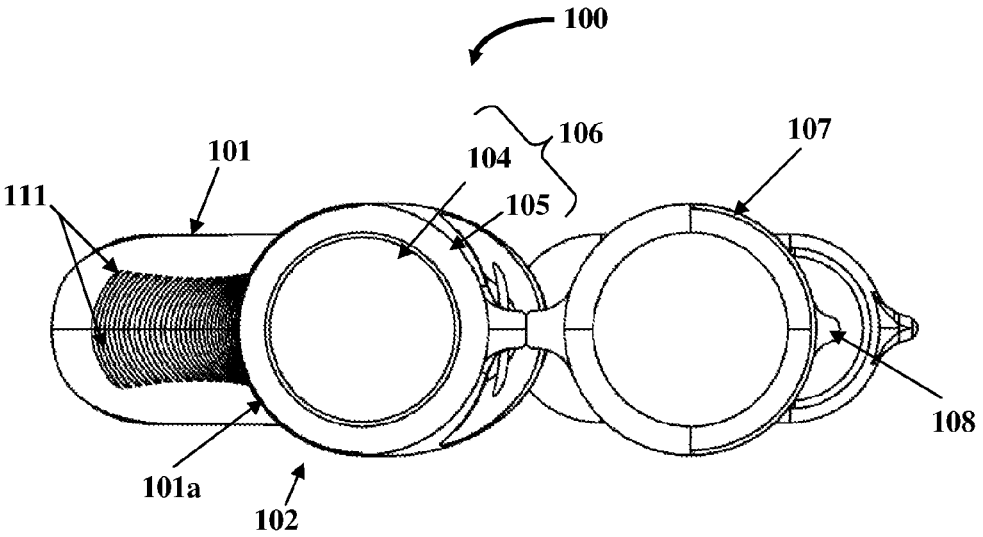
FIG. 4 exemplarily illustrates a top view of the dual end liquid applicator.

FIG. 4 exemplarily illustrates a top view of the dual end liquid applicator 100. The profiles of the reservoir handle 101, the first head member 102, and the inner profile of the flippable lid 107 with the molded lid tab 108 are exemplarily illustrated in FIG. 4. FIG. 4 exemplarily illustrates the flippable lid 107 in an open position with the roller ball 104 and the ball lock ring 105 of the roller ball assembly 106 exposed. A user opens and closes the flippable lid 107 over the first head member 102 by flipping the molded lid tab 108 of the flippable lid 107 using a single hand.

Figure 5:
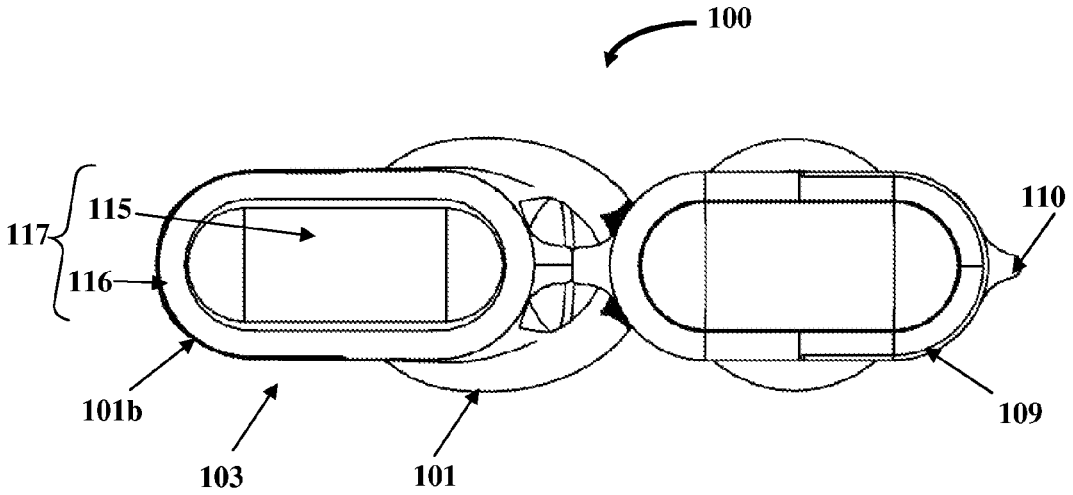
FIG. 5 exemplarily illustrates a bottom view of the dual end liquid applicator.

FIG. 5 exemplarily illustrates a bottom view of the dual end liquid applicator 100. FIG. 5 also exemplarily illustrates the second head member 103 housing the elongate roller assembly 117. The profiles of the reservoir handle 101, the second head member 103, and the inner profile of the flippable lid 109 with the molded lid tab 110 are exemplarily illustrated in FIG. 5. FIG. 5 exemplarily illustrates the flippable lid 109 in an open position with the elongated roller 115 and the roller lock ring 116 of the elongate roller assembly 117 exposed. A user opens and closes the flippable lid 109 over the second head member 103 by flipping the molded lid tab 110 of the flippable lid 109 using a single hand.

Figure 6A:
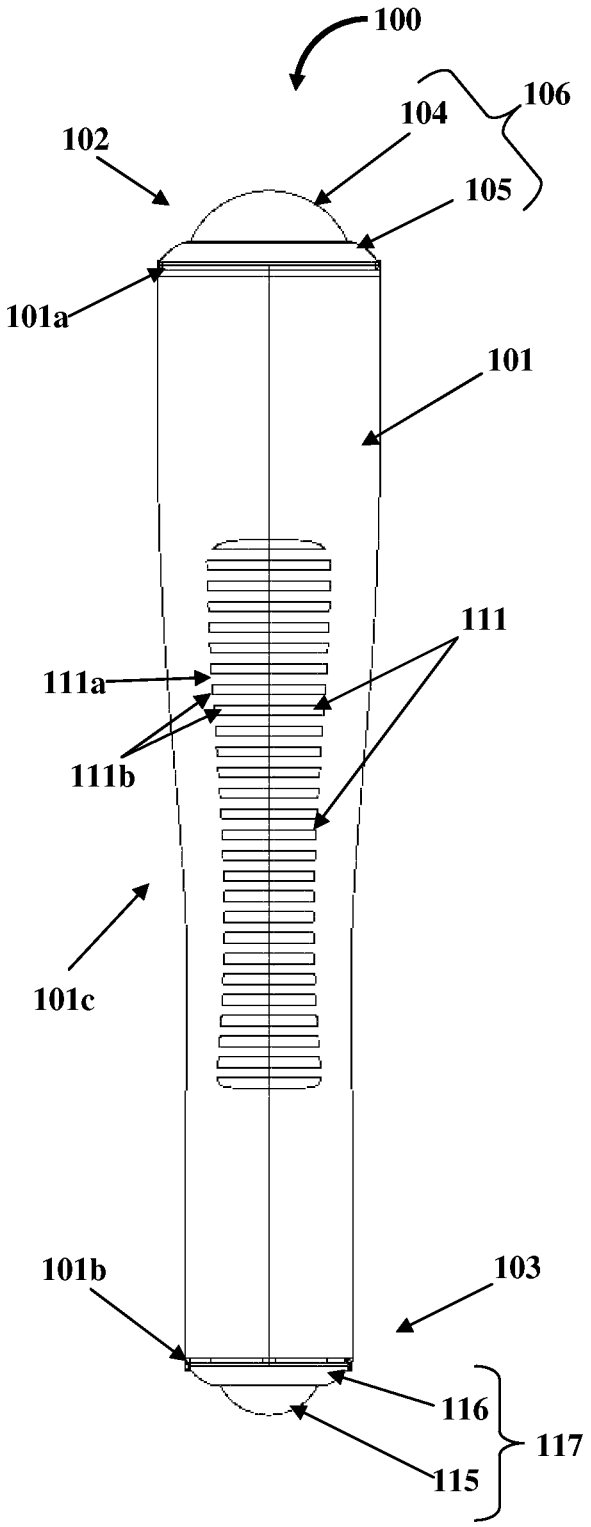
FIG. 6A exemplarily illustrates a left side elevation view of the dual end liquid applicator.
Figure 6B:
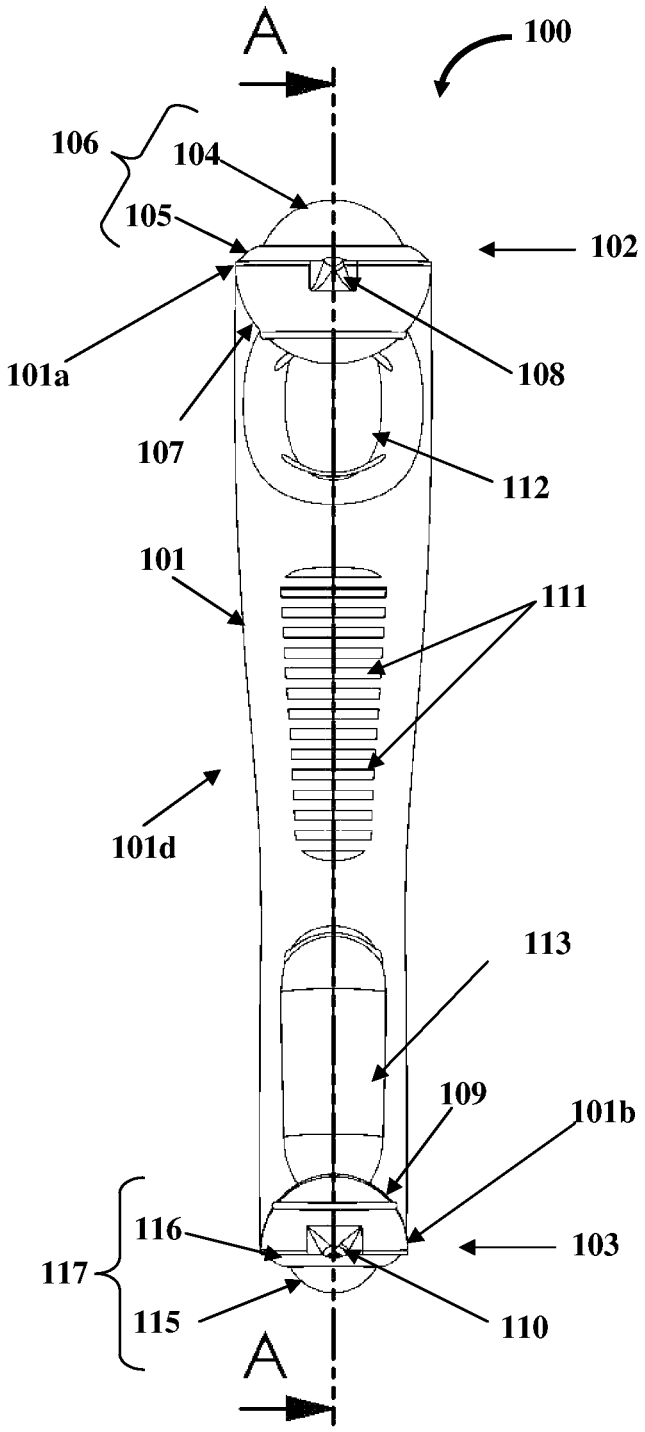
FIG. 6B exemplarily illustrates a right side elevation view of the dual end liquid applicator.

FIGS. 6A-6B exemplarily illustrate a left side elevation view and a right side elevation view respectively, of the dual end liquid applicator 100. The reservoir handle 101 is an elongate structure with the width of the reservoir handle 101 tapering from the second head member 103 to the first head member 102. The gripping sections 111 are defined between the first head member 102 and the second head member 103. The gripping sections 111 are configured, for example, as horizontal grooves 111*b* of varying lengths defined within a predetermined length on the contour of the reservoir handle 101. The space 111*a* between the grooves 111*b* of the gripping sections 111 are, for example, about 0.05 inches. The length of the gripping section 111 on the left opposing side 101*c* of the dual end liquid applicator 100 exemplarily illustrated in FIG. 6A is, for example, about 2.50 inches. The length of the gripping section 111 on the right opposing side 101*c* of the dual end liquid applicator 100 exemplarily illustrated in FIG. 6B is, for example, about 1.50 inches. The gripping sections 111 allow a user to firmly hold the dual end liquid applicator 100 using a single hand during application on a contact surface 901 or 902 exemplarily illustrated in FIGS. 9A-9B, and to avoid slippage of the reservoir handle 101 from the user's hand, if a dispensing liquid 1001 exemplarily illustrated in FIG. 10A, for example, a lubricant or a body lotion spills over the reservoir handle 101. FIG. 6B further shows the cradle 112 defined proximal to the first head member 102 and the cradle 113 defined proximal to the second head member 103. The cradle 112 is of a generally circular shape configured to receive and hold the flippable lid 107 inside the cradle 112. The cradle 113 is of a generally elongated oval shape configured to receive and hold the flippable lid 109 inside the cradle 113.

Figure 7:
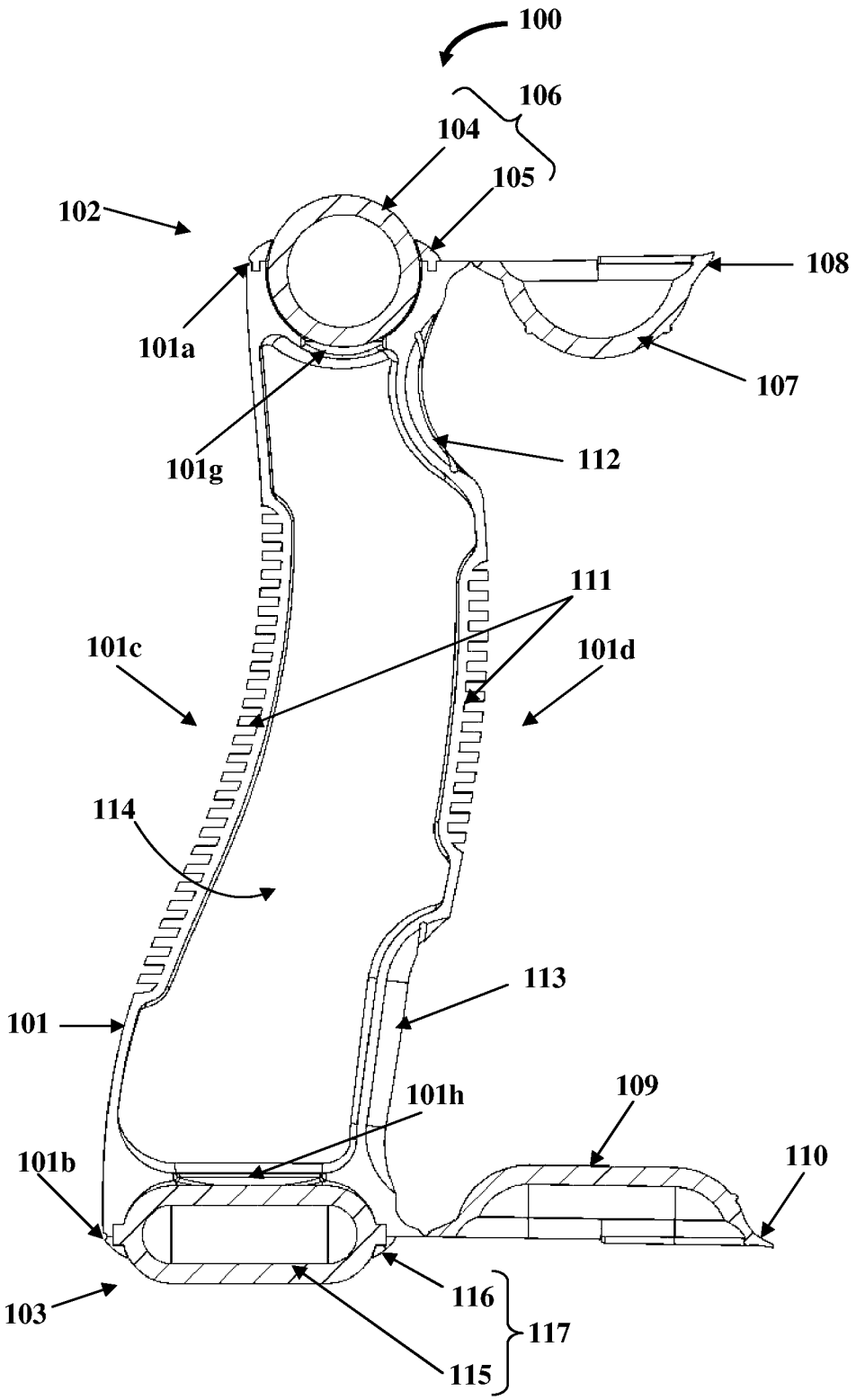
FIG. 7 exemplarily illustrates a sectional view of the dual end liquid applicator defined along a section A-A of FIG. 6B.

FIG. 7 exemplarily illustrates a sectional view of the dual end liquid applicator 100 defined along a section A-A of FIG. 6B. The reservoir handle 101 of the dual end liquid applicator 100 defines an internal cavity 114 between the first head member 102 and the second head member 103 of the dual end liquid applicator 100. The internal cavity 114 is, for example, an elongate hollow structure of a predefined geometry configured to contain a dispensing liquid 1001 as exemplarily illustrated in FIG. 10A. The internal cavity 114 stores the dispensing liquid 1001 to be dispensed on to a contact surface 901 or 902 exemplarily illustrated in FIGS. 9A-9B. Compression pressure is applied by the user on the gripping sections 111 to transfer the dispensing liquid 1001 from the internal cavity 114 and dispense the dispensing liquid 1001 through the first head member 102 or the second head member 103.

Figure 8A:
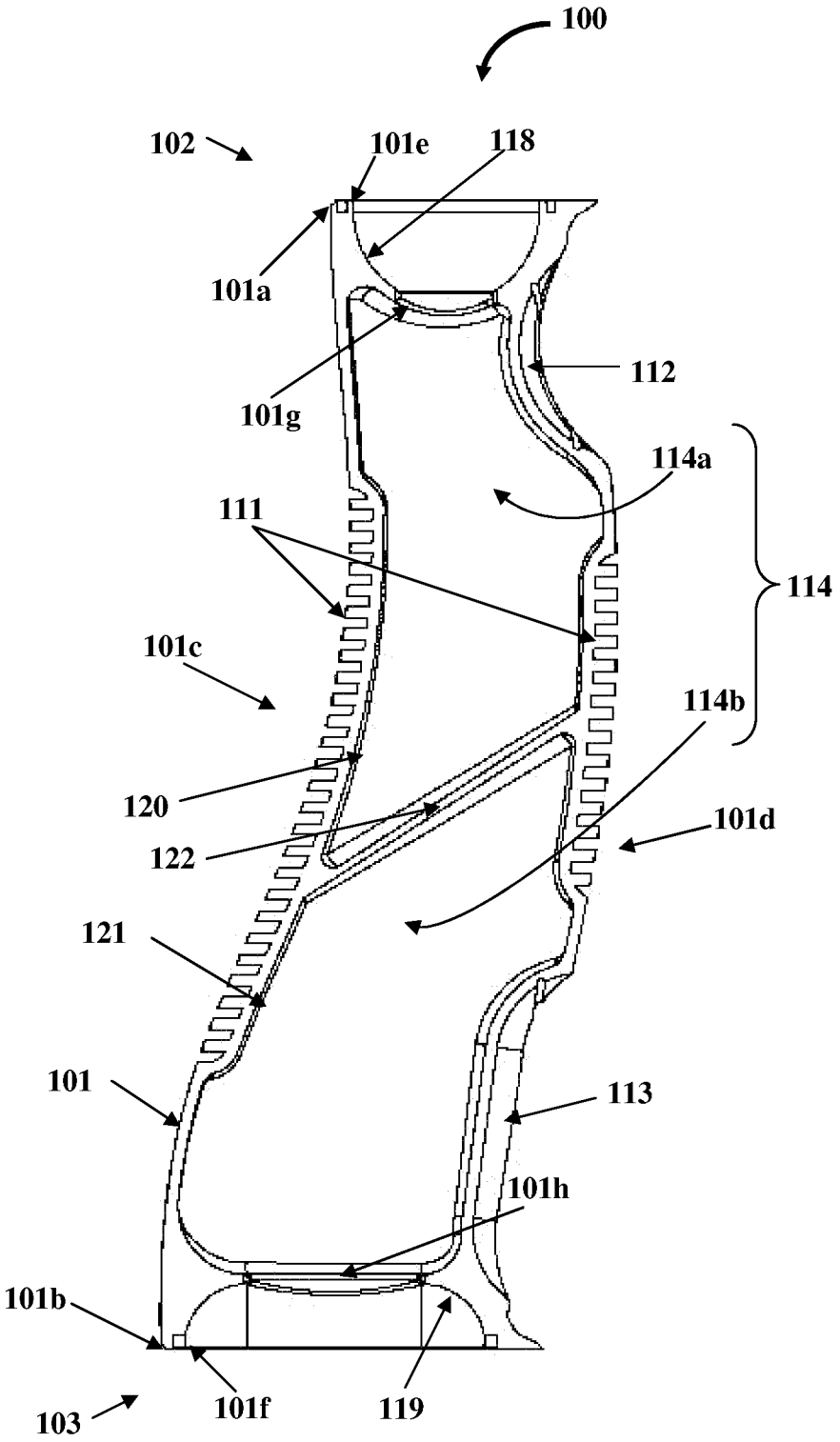
FIG. 8A exemplarily illustrates a front cutaway view of an embodiment of the dual end liquid applicator, showing reservoirs defined in the internal cavity of the reservoir handle.
Figure 8B:
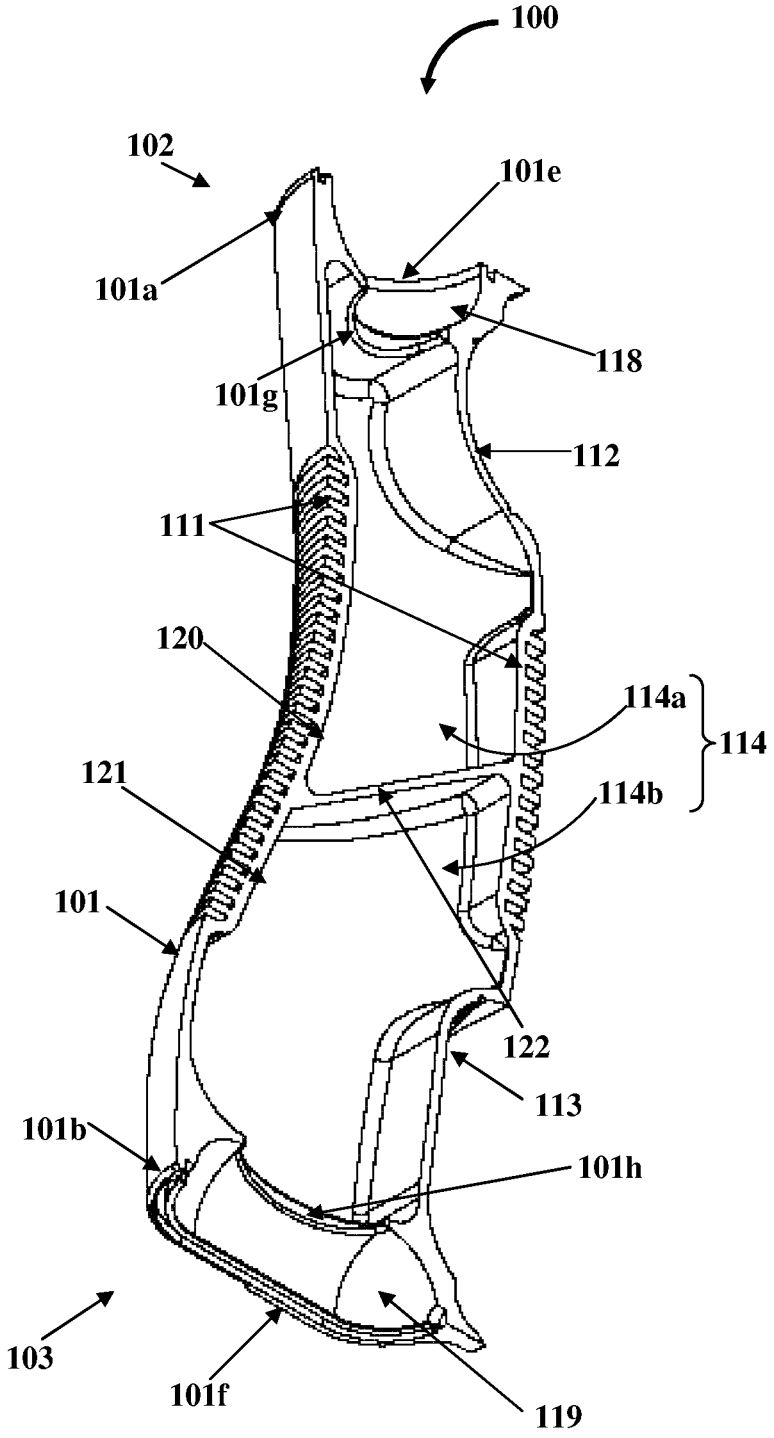
FIGS. 8B-8C exemplarily illustrate cutaway perspective views of the embodiment of the dual end liquid applicator, showing reservoirs defined in the internal cavity of the reservoir handle.
Figure 8C:
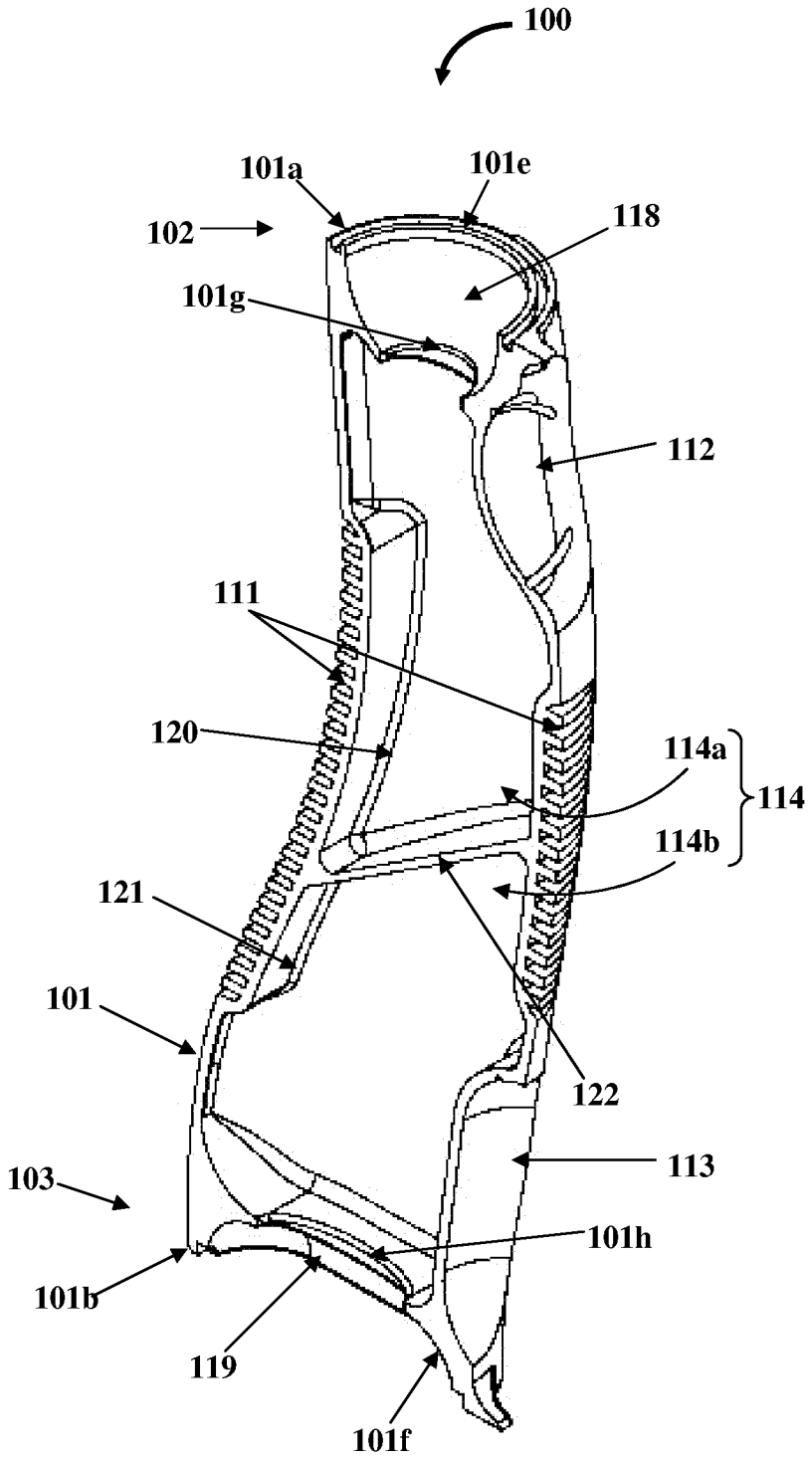

FIGS. 8A-8C exemplarily illustrate cutaway views of an embodiment of the dual end liquid applicator 100, showing reservoirs 120 and 121 defined in the internal cavity 114 of the reservoir handle 101. The internal cavity 114 of the reservoir handle 101 is chambered to define, for example, two reservoirs 120 and 121, where the first reservoir 120 stores one type of dispensing liquid 1001 exemplarily illustrated in FIG. 10A in an internal cavity 114*a*, while the second reservoir 121 stores another type or the same type of dispensing liquid 1001 as the dispensing liquid 1001 in the first reservoir 120, in the internal cavity 114*b*. The first reservoir 120 is defined proximal to the first head member 102. The second reservoir 121 is defined proximal to the second head member 103. A junction element 122 separates the first reservoir 120 and the second reservoir 121. The reservoirs 120 and 121 are configured to store one dispensing liquid 1001 or different dispensing liquids 1001 in their respective internal cavities 114*a* and 114*b*. The dispensing liquids 1001 are dispensed from the first reservoir 120 through the first head member 102, and from the second reservoir 121 through the second head member 103.

Figure 9A:
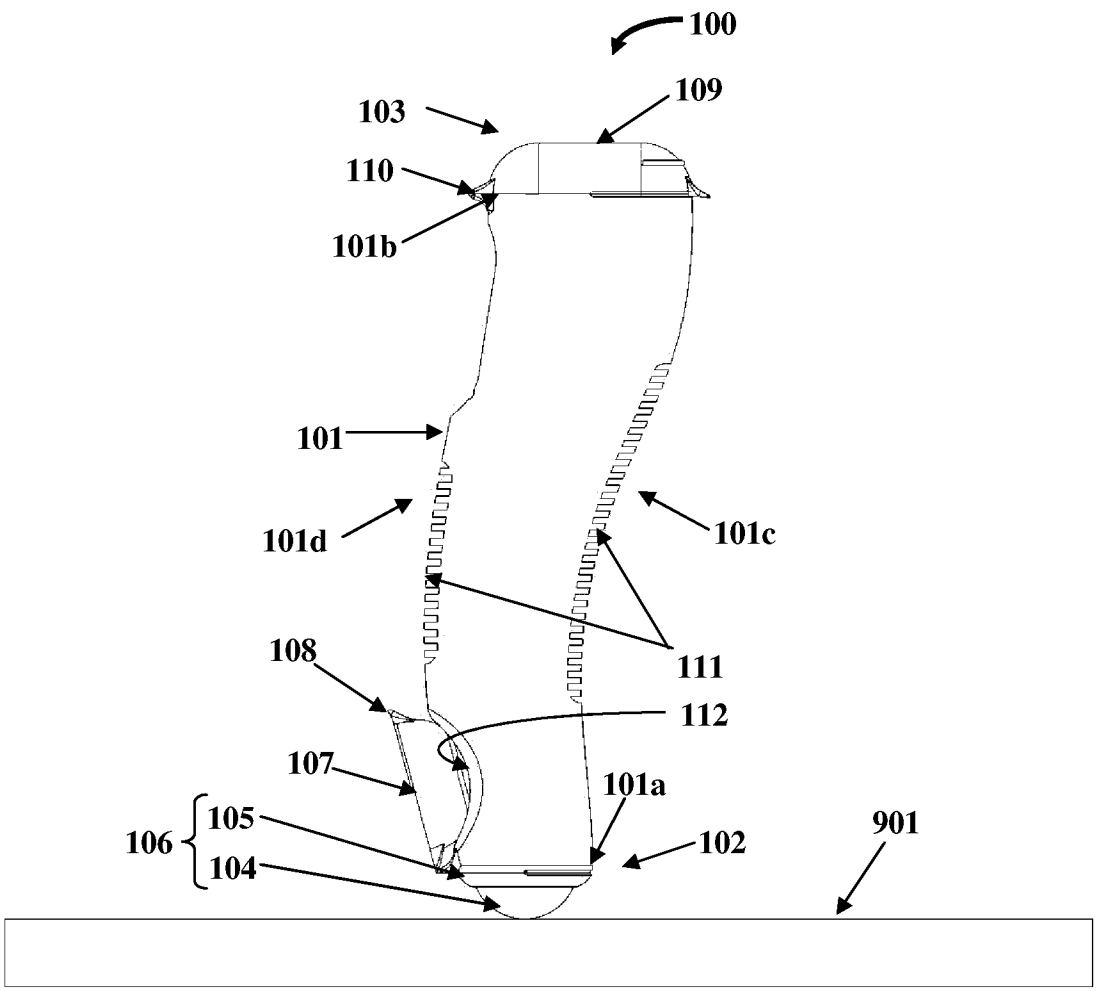
FIG. 9A exemplarily illustrates positioning of the dual end liquid applicator on a contact surface for application of a dispensing liquid on the contact surface via the first head member.

The user holds the dual end liquid applicator 100 in a substantially vertical position with the roller ball 104 of the roller ball assembly 106 in contact with the contact surface 901 exemplarily illustrated in FIG. 9A, and applies a pressure on the gripping sections 111 of the reservoir handle 101 to extrude the dispensing liquid 1001 from the internal cavity 114*a* of the first reservoir 120 through the outlet hole 101*g* and through to the first opening 101*e* defined at the first end 101*a* of the reservoir handle 101 to coat the roller ball 104. As the roller ball 104 coated with the dispensing liquid 1001 is rolled over and in contact with the contact surface 901, the dispensing liquid 1001 is transferred from the coated roller ball 104 to the contact surface 901. Similarly, when the user wishes to dispense the dispensing liquid 1001 from the elongated roller 115 of the elongate roller assembly 117 to the contact surface 902 exemplarily illustrated in FIG. 9B, the user holds the dual end liquid applicator 100 in a substantially vertical position with the elongated roller 115 in contact with the contact surface 902 and applies a pressure to the gripping sections 111 to extrude the dispensing liquid 1001 from the internal cavity 114*b* of the second reservoir 121 through the outlet hole 101*h* and through to the second opening 101*f* defined at the second end 101*b* of the reservoir handle 101 to coat the surface of the elongated roller 115. The dispensing liquid 1001 is dispensed on the contact surface 902 when the elongated roller 115 coated with the dispensing liquid 1001 is rolled over and in contact with the user's contact surface 902.

Figure 9B:
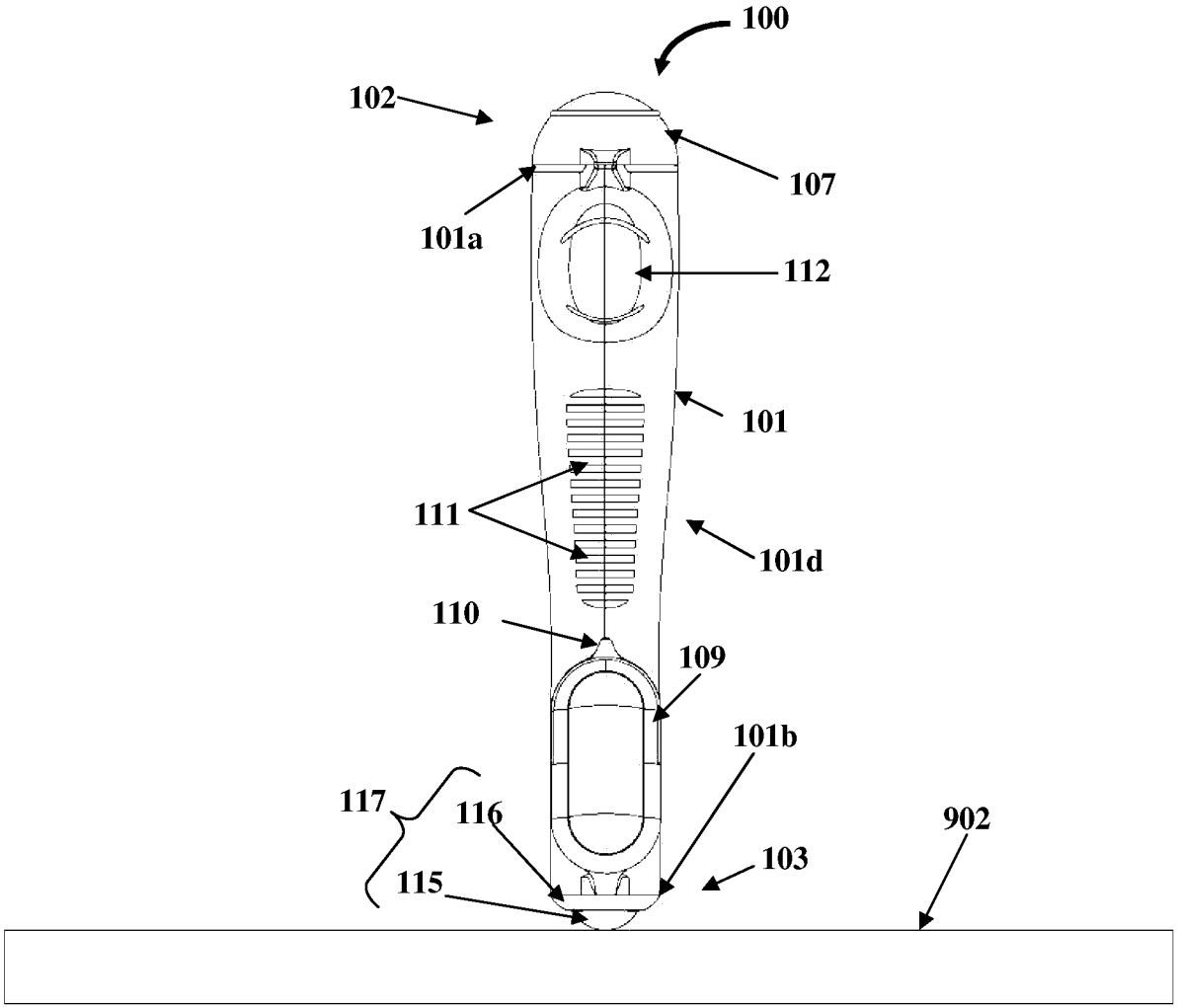
FIG. 9B exemplarily illustrates positioning of the dual end liquid applicator on a contact surface for application of a dispensing liquid on the contact surface via the second head member.
Figure 10A:
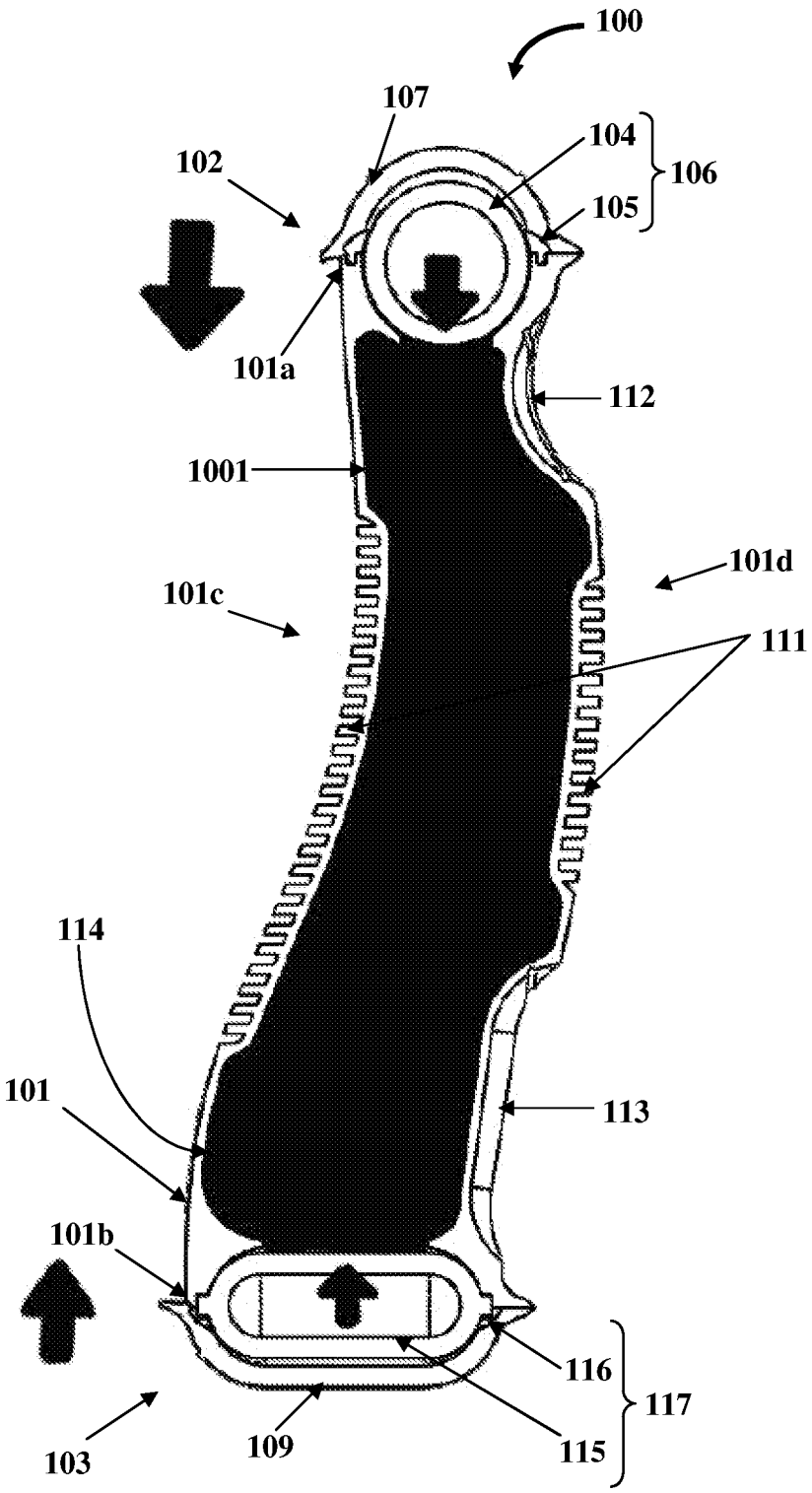
FIG. 10A exemplarily illustrates a cutaway view of the dual end liquid applicator, showing a dispensing liquid stored in the internal cavity of the reservoir handle.

FIGS. 9A-9B exemplarily illustrate positioning of the dual end liquid applicator 100 on contact surfaces 901 and 902 for application of a dispensing liquid 1001 exemplarily illustrated in FIG. 10A, on the contact surfaces 901 and 902 via the first head member 102 and the second head member 103 of the dual end liquid applicator 100 respectively. A female user or a male user may grip the reservoir handle 101 by the gripping sections 111 to dispense the dispensing liquid 1001 contained in the internal cavity 114 of the reservoir handle 101 to a contact surface 901 or 902. FIG. 9A exemplarily illustrates positioning of the dual end liquid applicator 100 on the contact surface 901, for example, of a female body part or any other contact surface 901 via the first head member 102. In an example, a female user lifts the dual end liquid applicator 100 from where the dual end liquid applicator 100 rests and flips the flippable lid 107 open using a single hand. The flippable lid 107 is retained in the open position inside the cradle 112. When the female user selects the first head member 102 and rolls the roller ball 104 of the roller ball assembly 106 over the contact surface 901 of the female body part, the dispensing liquid 1001 is transferred from the internal cavity 114 of the reservoir handle 101 and coated on the surface of the roller ball 104. The dispensing liquid 1001 coated on the surface of the roller ball 104 is transferred to the contact surface 901 of the female body part when the coated roller ball 104 is rolled over and in contact with the contact surface 901, thereby allowing application of the dispensing liquid 1001 on the contact surface 901 of the female body part.

FIG. 9B exemplarily illustrates positioning of the dual end liquid applicator 100 on a contact surface 902 of a male body part or any other contact surface 902 via the second head member 103. In an example, a male user flips open the flippable lid 109 using a single hand. The flippable lid 109 is retained in the open position inside the cradle 113. When the male user rolls the elongated roller 115 of the elongate roller assembly 117 over the contact surface 902 of the male body part, the dispensing liquid 1001 is transferred from the internal cavity 114 of the reservoir handle 101 and coated on the surface of the elongated roller 115. The dispensing liquid 1001 coated on the surface of the elongated roller 115 is transferred to the contact surface 902 of the male body part when the coated elongated roller 115 is rolled over and in contact with the contact surface 902, thereby allowing application of the dispensing liquid 1001 on the contact surface 902 of the male body part.

The first end 101*a* and the second end 101*b* of the reservoir handle 101 of the dual end liquid applicator 100 disclosed herein allow a clean single handed application of the dispensing liquid 1001 to a user's contact surface 901 or 902. The user has two choices for application, for example, the user can either choose the first head member 102 comprising the roller ball assembly 106 or the second head member 103 comprising the elongate roller assembly 117 for applying the dispensing liquid 1001 to the contact surface 901 or 902. The roller ball 104 of the roller ball assembly 106 is, for example, a smooth ball, while the elongated roller 115 of the elongate roller assembly 117 is, for example, a cylindrical roller which has a wide surface area for greater area coverage. The roller ball 104 of the roller ball assembly 106 and the elongated roller 115 of the elongate roller assembly 117 glide over the contact surfaces 901 and 902 respectively, to dispense the dispensing liquid 1001 contained in the internal cavity 114 of the dual end liquid applicator 100 to the contact surfaces 901 and 902. The first head member 102 and the second head member 103 are configured to expedite the flow of the dispensing liquid 1001 from the first opening 101*e* and the second opening 101*f* exemplarily illustrated in FIG. 2 and FIGS. 8A-8C defined at the first end 101*a* and the second end 101*b* of the reservoir handle 101 respectively. The facile opening and closing of the flippable lids 107 and 109 at the first end 101*a* and the second end 101*b* of the reservoir handle 101 respectively, maintain viscosity of the dispensing liquid 1001.

FIGS. 10A-10E exemplarily illustrate storage and application of a dispensing liquid 1001 by the dual end liquid applicator 100. FIG. 10A exemplarily illustrates a cutaway view of the dual end liquid applicator 100, showing a dispensing liquid 1001 stored in the internal cavity 114 of the reservoir handle 101. In an embodiment, the internal cavity 114 is filled with the dispensing liquid 1001 by removing either the roller ball assembly 106 of the first head member 102 or the elongate roller assembly 117 of the second head member 103.

Figure 10B:
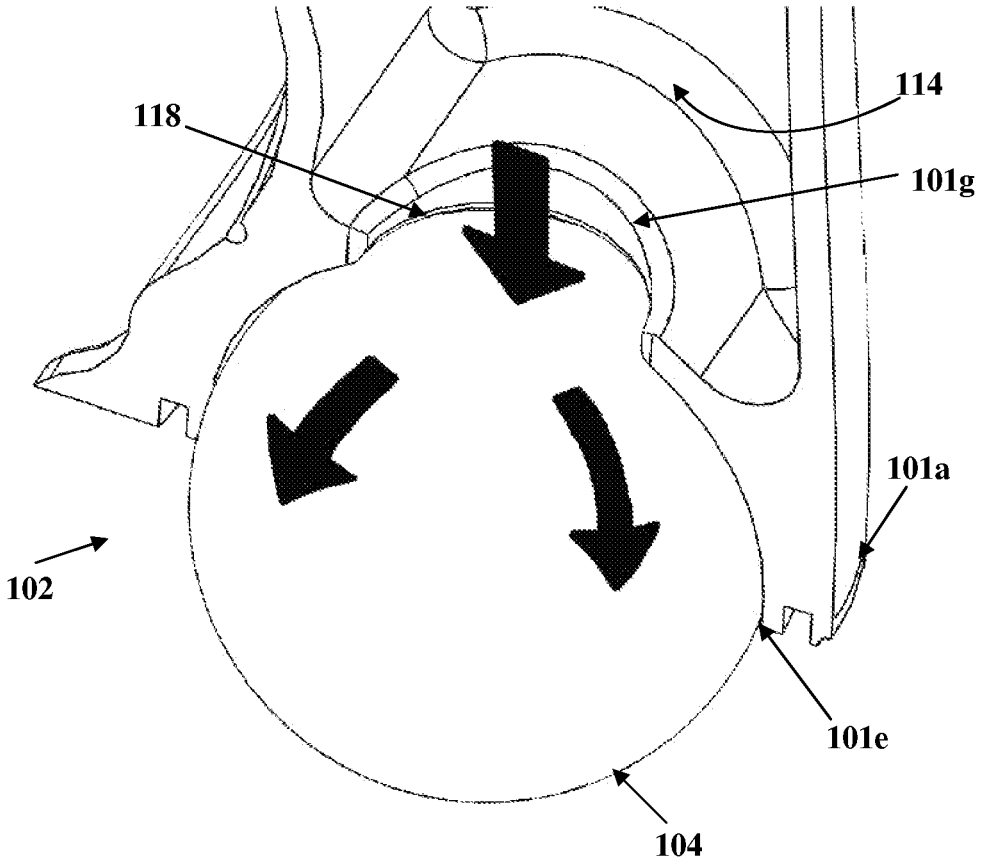
FIG. 10B exemplarily illustrates a partial cutaway view of the first head member of the dual end liquid applicator, showing a roller ball rollably positioned within a hemispherical housing defined proximal to a first opening at a first end of the reservoir handle.

FIG. 10B exemplarily illustrates a partial cutaway view of the first head member 102 of the dual end liquid applicator 100, showing the roller ball 104 rollably positioned within the hemispherical housing 118 defined proximal to the first opening 101*e* at the first end 101*a* of the reservoir handle 101. The roller ball 104 is exposed to the internal cavity 114 of the reservoir handle 101 through the outlet hole 101*g*. When the user applies pressure on the gripping sections 111 of the reservoir handle 101 exemplarily illustrated in FIG. 10A, a desired amount of dispensing liquid 1001 is extruded from the internal cavity 114 to coat the surface of the roller ball 104 as exemplarily shown by arrows in FIG. 10B. The continuous rolling of the roller ball 104 on the contact surface 901 as exemplarily illustrated in FIG. 10C, allows continuous dispensing of the dispensing liquid 1001 onto the roller ball 104 and thereafter onto the contact surface 901.

Figure 10C:
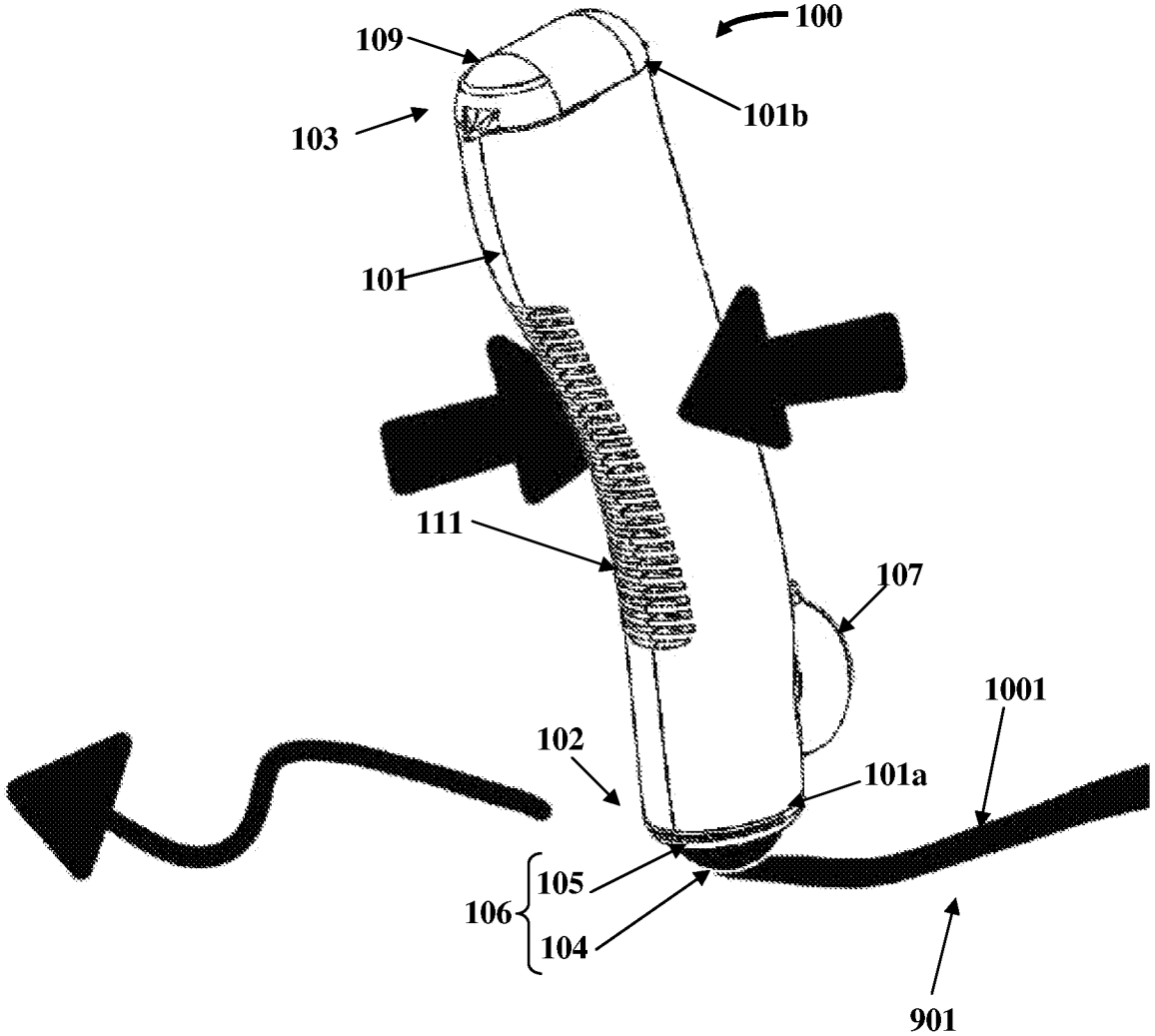
FIG. 10C exemplarily illustrates an application of a dispensing liquid on a contact surface using a roller ball assembly housed in the first head member of the dual end liquid applicator.

FIG. 10C exemplarily illustrates an application of a dispensing liquid 1001 on a contact surface 901 using the roller ball assembly 106 housed in the first head member 102 of the dual end liquid applicator 100. The user grips the gripping sections 111 of the reservoir handle 101 to hold the dual end liquid applicator 100 and flips open the flippable lid 107 to expose the roller ball assembly 106. The first head member 102 of the dual end liquid applicator 100 is positioned in a downward direction to allow the dispensing liquid 1001 to flow in a downward direction due to gravity and/or by the pressure exerted on the gripping sections 111 by the user. The user applies pressure on the gripping sections 111 of the reservoir handle 101 in the direction shown by arrows in FIG. 10C to force the dispensing liquid 1001 through the outlet hole 101*g* exemplarily illustrated in FIG. 10B. The dispensing liquid 1001 exits the outlet hole 101*g* to coat the roller ball 104 of the roller ball assembly 106 as exemplarily illustrated in FIG. 10B. When the user rolls the roller ball 104 coated with the dispensing liquid 1001 over and in contact with the contact surface 901 is a predefined direction, the dispensing liquid 1001 coated on the roller ball 104 is dispensed onto the contact surface 901.

Figure 10D:
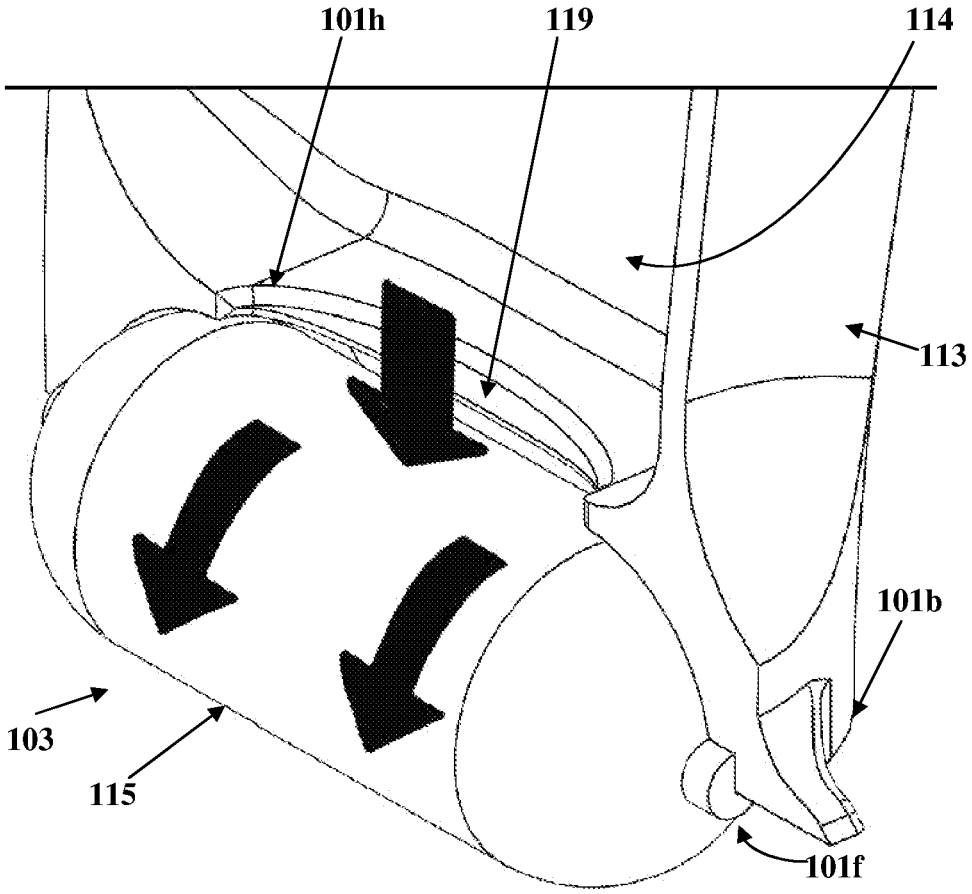
FIG. 10D exemplarily illustrates a partial cutaway view of the second head member of the dual end liquid applicator, showing an elongated roller rollably positioned within an elongate housing defined proximal to a second opening at a second end of the reservoir handle.

FIG. 10D exemplarily illustrates a partial cutaway view of the second head member 103 of the dual end liquid applicator 100, showing the elongated roller 115 rollably positioned within the elongate housing 119 defined proximal to the second opening 101*f* at the second end 101*b* of the reservoir handle 101. The elongated roller 115 is directly exposed to the internal cavity 114 of the reservoir handle 101 through the outlet hole 101*h*. When the user applies a pressure on the gripping sections 111 of the reservoir handle 101, a desired amount of dispensing liquid 1001 is extruded from the internal cavity 114 to coat the elongated roller 115 as exemplarily shown by arrows in FIG. 10D. Rolling the elongated roller 115 on the contact surface 902 as exemplarily illustrated in FIG. 10E, allows continuous dispensing of the dispensing liquid 1001 onto the elongated roller 115 and thereafter onto the contact surface 902.

Figure 10E:
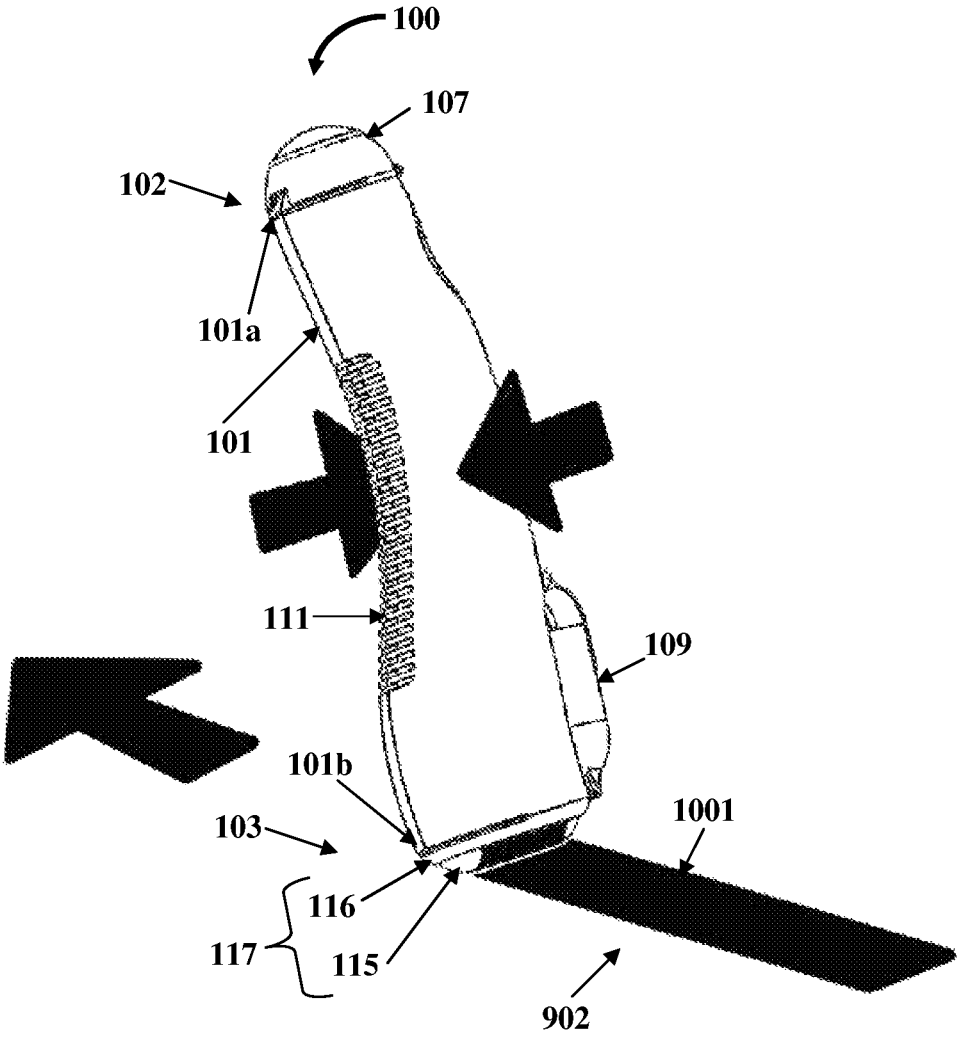
FIG. 10E exemplarily illustrates an application of a dispensing liquid on a contact surface using an elongate roller assembly housed in the second head member of the dual end liquid applicator.

FIG. 10E exemplarily illustrates an application of a dispensing liquid 1001 on a contact surface 902 using the elongate roller assembly 117 housed in the second head member 103 of the dual end liquid applicator 100. The user grips the gripping sections 111 of the reservoir handle 101 to hold the dual end liquid applicator 100 and flips open the flippable lid 109 to expose the elongate roller assembly 117. The second head member 103 of the dual end liquid applicator 100 is pointed in a downward direction to allow the dispensing liquid 1001 to flow in a downward direction due to gravity and/or by the pressure exerted on the gripping sections 111 by the user. The user applies pressure on the gripping sections 111 of the reservoir handle 101 in the direction shown by arrows in FIG. 10E to force the dispensing liquid 1001 to pass through the outlet hole 101*h* exemplarily illustrated in FIG. 10D. The dispensing liquid 1001 exits the outlet hole 101*h* to coat the elongated roller 115 of the elongate roller assembly 117 as exemplarily illustrated in FIG. 10D. When the user rolls the elongated roller 115 coated with the dispensing liquid 1001 over and in contact with the contact surface 902 in a predefined direction, the dispensing liquid 1001 coated on the elongated roller 115 is dispensed onto the contact surface 902.

Figure 11:
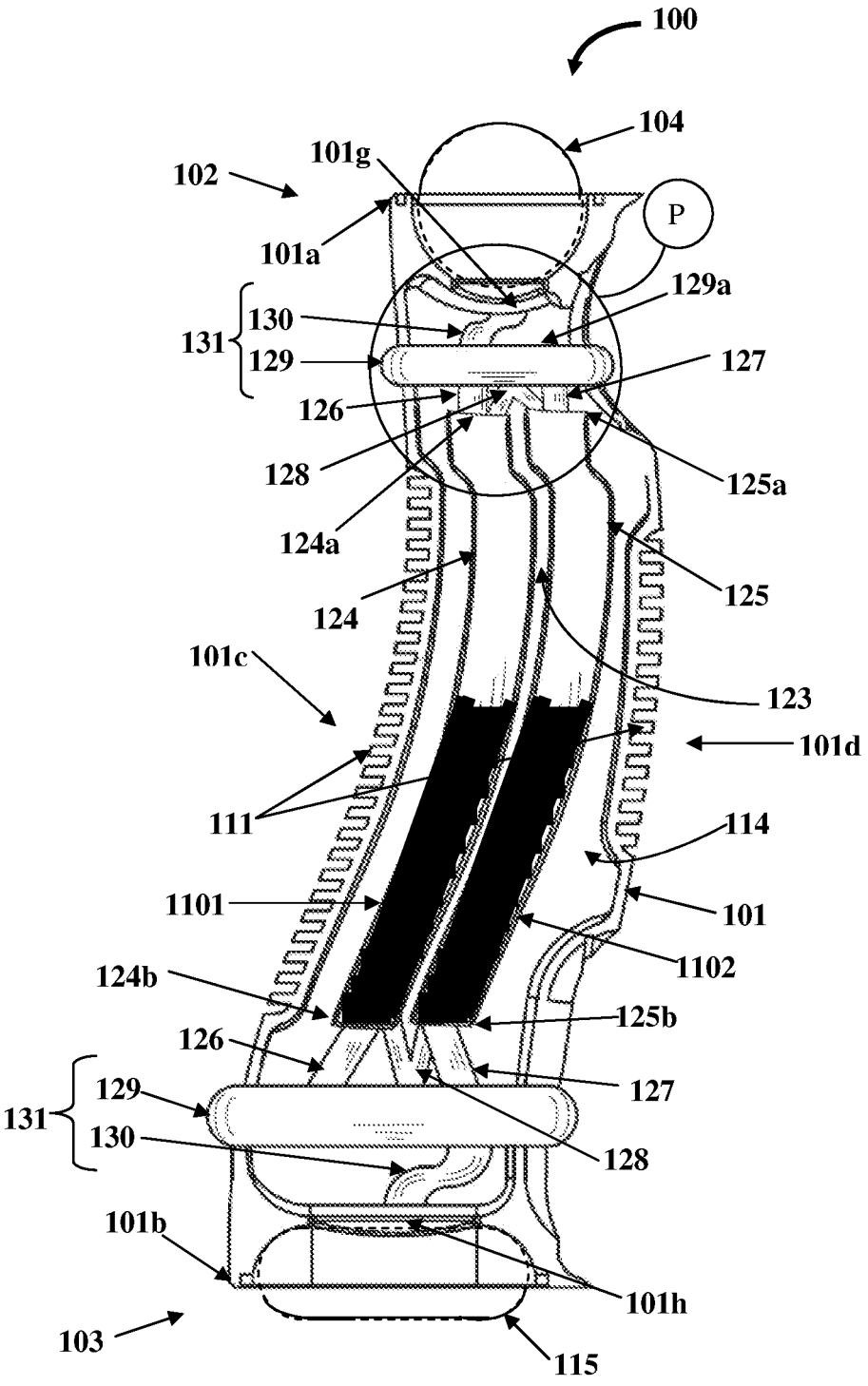
FIG. 11 exemplarily illustrates a cutaway view of an embodiment of the dual end liquid applicator, showing a liquid dispenser system operably connected in the internal cavity of the reservoir handle.

FIG. 11 exemplarily illustrates a cutaway view of an embodiment of the dual end liquid applicator 100, showing a liquid dispenser system 123 operably connected in the internal cavity 114 of the reservoir handle 101. In an embodiment, the dual end liquid applicator 100 disclosed herein further comprises the liquid dispenser system 123 for transferring and dispensing a first dispensing liquid 1101, a second dispensing liquid 1102, or a combination thereof to a contact surface 901 or 902 exemplarily illustrated in FIGS. 9A-9B. The liquid dispenser system 123 comprises at least two elongate reservoirs, for example, a first elongate reservoir 124 and a second elongate reservoir 125, a first outlet pipe 126 extending from each of the opposing ends 124*a* and 124*b* of the first elongate reservoir 124, a first outlet pipe 127 extending from each of the opposing ends 125*a* and 125*b* of the second elongate reservoir 125, second outlet pipes 134 and 135 exemplarily illustrated in FIGS. 12B-12C, and a liquid transfer assembly 131. The elongate reservoirs 124 and 125 are positioned substantially parallel to each other within the internal cavity 114 of the reservoir handle 101. The first elongate reservoir 124 stores the first dispensing liquid 1101. The second elongate reservoir 125 stores the second dispensing liquid 1102. The second dispensing liquid 1102 can be the same as the first dispensing liquid 1101 or can be a different dispensing liquid.

The first outlet pipe 126 of the first elongate reservoir 124 and the first outlet pipe 127 of the second elongate reservoir 125 are in fluid communication with the first elongate reservoir 124 and the second elongate reservoir 125 respectively. The first outlet pipe 126 extending from the opposing ends 124*a* and 124*b* of the first elongate reservoir 124 transfers and dispenses the first dispensing liquid 1101 from the first elongate reservoir 124 to outlet holes 101*g* and 101*h* proximal to the first end 101*a* and the second end 101*b* of the reservoir handle 101 respectively. Similarly, the first outlet pipe 127 extending from the opposing ends 125*a* and 125*b* of the second elongate reservoir 125 transfers and dispenses the second dispensing liquid 1102 from the second elongate reservoir 125 to the outlet holes 101*g* and 101*h* respectively.

Figure 12A:
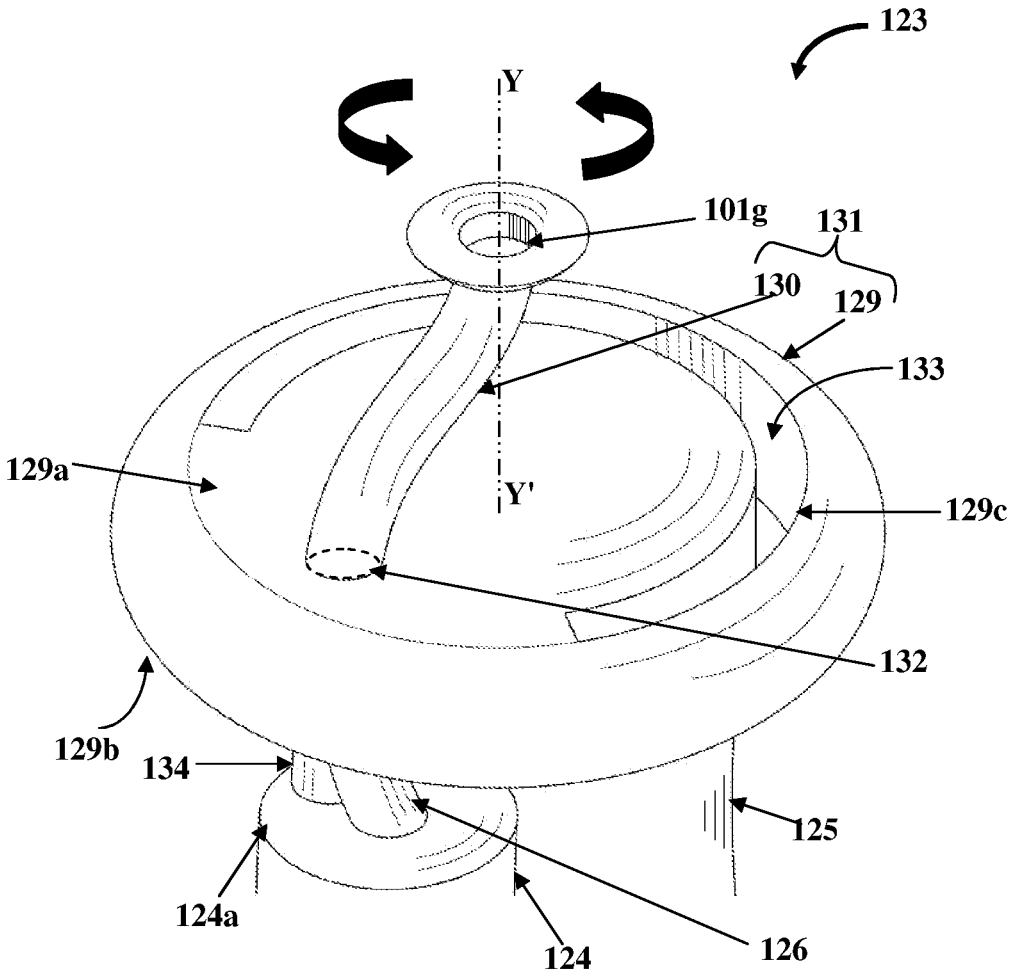
FIG. 12A exemplarily illustrates an enlarged top perspective view of a portion P shown in FIG. 11 of the embodiment of the dual end liquid applicator, showing the liquid dispenser system operably connected to the outlet hole proximal to the first end of the reservoir handle.
Figure 12B:
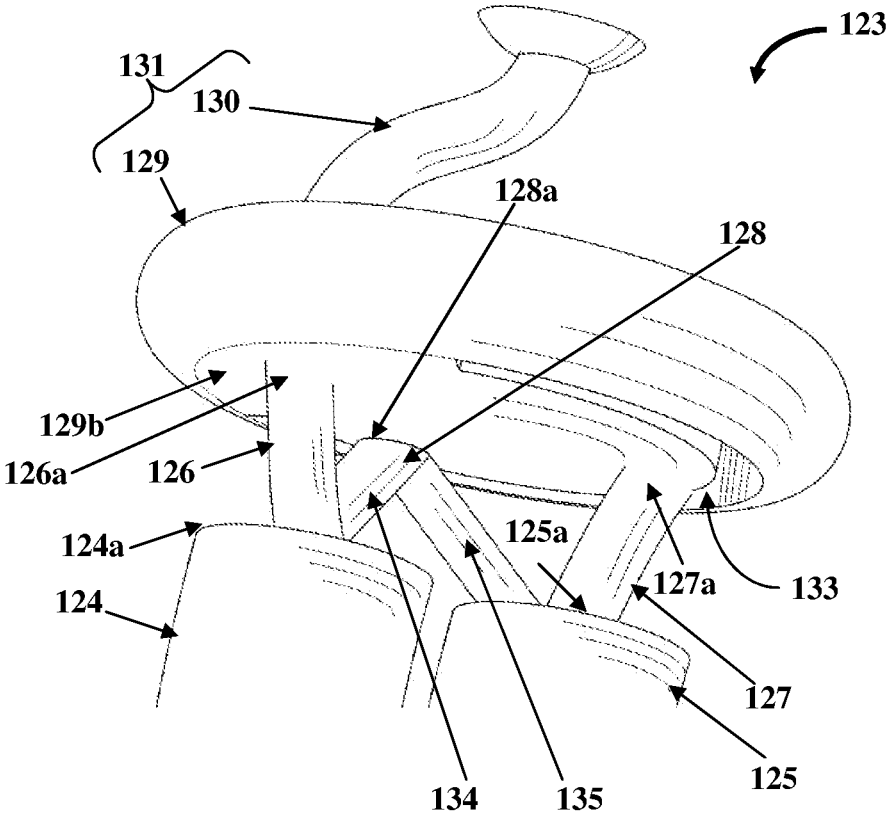
FIG. 12B exemplarily illustrates an enlarged bottom perspective view of the portion P shown in FIG. 11.
Figure 12C:
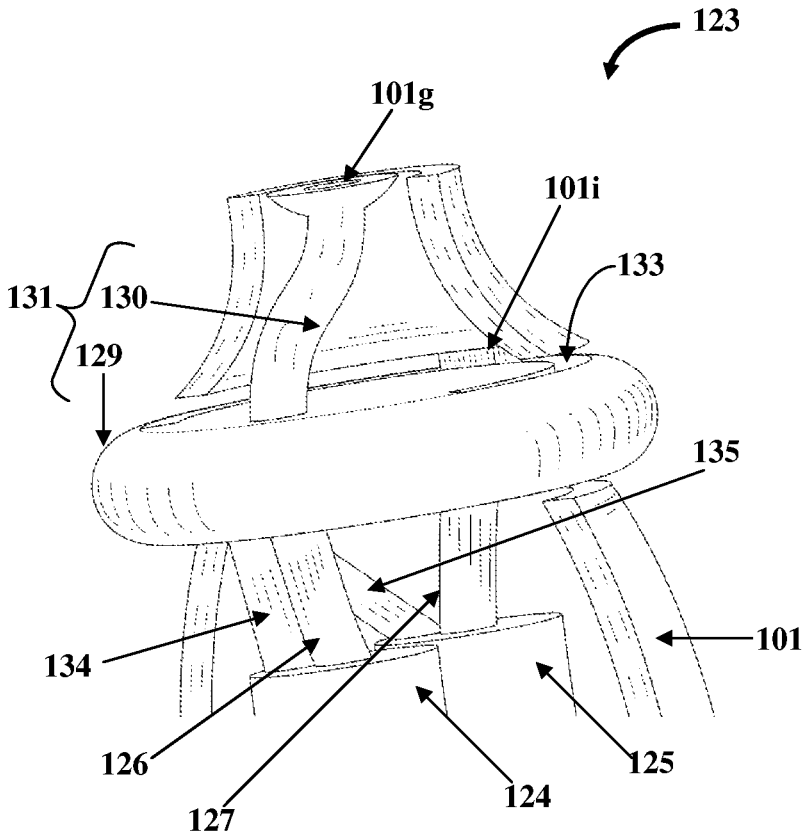
FIG. 12C exemplarily illustrates an enlarged perspective view of the portion P shown in FIG. 11, with a portion of the reservoir handle slidably engaged in a sleeve of a flexible disc of the liquid dispenser system.

The second outlet pipe 134 exemplarily illustrated in FIGS. 12A-12C extends from the opposing ends 124*a* and 124*b* of the first elongate reservoir 124. The second outlet pipe 135 extends from the opposing ends 125*a* and 125*b* of the second elongate reservoir 125. The second outlet pipes 134 and 135 are in fluid communication with the elongate reservoirs 124 and 125 respectively. In an embodiment, the second outlet pipes 134 and 135 are fused to create a mixer outlet pipe 128. The mixer outlet pipe 128 is configured to transfer and dispense a combination of the first dispensing liquid 1101 and the second dispensing liquid 1102 from the elongate reservoirs 124 and 125 to the outlet holes 101*g* and 101*h*.

The liquid transfer assembly 131 of the liquid dispenser system 123 is operably connected to each of the first end 101*a* and the second end 101*b* of the reservoir handle 101. The liquid transfer assembly 131 comprises a flexible disc 129, for example, made of rubber, and a transfer pipe 130. The flexible disc 129 comprises a hole 132 proximal to an inner circumference 129*c* of the flexible disc 129. The flexible disc 129 is disposed proximal to each of the first end 101*a* and the second end 101*b* of the reservoir handle 101. The holes 132 in the flexible discs 129 at the first end 101*a* and the second end 101*b* of the reservoir handle 101 are in fluid communication with the outlet holes 101*g* and 101*h* respectively. The transfer pipe 130 is fixedly attached to the hole 132 on an upper surface 129*a* of the flexible disc 129 at each of the first end 101*a* and the second end 101*b* of the reservoir handle 101. The flexible disc 129 is rotatable to alternatively connect the hole 132 of the flexible disc 129 to the first outlet pipes 126 and 127 of the elongate reservoirs 124 and 125 respectively or to the mixer outlet pipe 128 and transfer and dispense the first dispensing liquid 1101, the second dispensing liquid 1102, or a combination thereof to the outlet hole 101*g* proximal to the first end 101*a* of the reservoir handle 101 or the outlet hole 101*h* proximal to the second end 101*b* of the reservoir handle 101, via the transfer pipe 130, when pressure is applied on the reservoir handle 101.

The roller ball assembly 106 as exemplarily illustrated in FIG. 1A and FIG. 2, is positioned above the outlet hole 101*g* proximal to the first end 101*a* of the reservoir handle 101. The first dispensing liquid 1101, the second dispensing liquid 1102, or the combination thereof, transferred and dispensed through the outlet hole 101*g*, coats the roller ball 104 of the roller ball assembly 106 to dispense the first dispensing liquid 1101, the second dispensing liquid 1102, or the combination thereof onto a contact surface 901, as exemplarily illustrated in FIG. 9A and FIG. 10C, when the roller ball 104 is rolled over the contact surface 901. Similarly, the elongate roller assembly 117 as exemplarily illustrated in FIG. 2, is positioned below the outlet hole 101*h* proximal to the second end 101*b* of the reservoir handle 101. The first dispensing liquid 1101, the second dispensing liquid 1102, or the combination thereof, transferred and dispensed through the outlet hole 101*h*, coats the elongated roller 115 of the elongate roller assembly 117 to dispense the first dispensing liquid 1101, the second dispensing liquid 1102, or the combination thereof onto a contact surface 902 as exemplarily illustrated in FIG. 9B and FIG. 10E, when the elongated roller 115 is rolled over the contact surface 902.

FIGS. 12A-12C exemplarily illustrate enlarged perspective views of a portion P shown in FIG. 11 of the embodiment of the dual end liquid applicator 100, showing the liquid dispenser system 123 operably connected to the outlet hole 101*g* proximal to the first end 101*a* of the reservoir handle 101. In an embodiment, the liquid transfer assembly 131 of the liquid dispenser system 123 disclosed herein further comprises a sleeve 133 defined along the inner circumference 129*c* of the flexible disc 129. The sleeve 133 is configured to slidably engage with a portion 101*i* of the reservoir handle 101 exemplarily illustrated in FIG. 12C, internally for enabling rotation of the flexible disc 129. As exemplarily illustrated in the enlarged top perspective view in FIG. 12A, the hole 132 is defined on the upper surface 129*a* of the flexible disc 129 of the liquid transfer assembly 131. The transfer pipe 130 extends from the hole 132 on the upper surface 129*a* of the flexible disc 129 to connect to the outlet hole 101*g* defined proximal to the first end 101*a* of the reservoir handle 101 exemplarily illustrated in FIG. 11. Similarly, the transfer pipe 130 extends from the hole 132 on the flexible disc 129 positioned at the second end 101*b* of the reservoir handle 101 to connect to the outlet hole 101*h* defined proximal to the second end 101*b* of the reservoir handle 101 exemplarily illustrated in FIG. 11. The liquid transfer assembly 131 is configured to rotate along an axis Y-Y' exemplarily illustrated in FIG. 12A, to alternate the connection between the liquid transfer assembly 131 and the first outlet pipes 126 and 127, or between the liquid transfer assembly 131 and the mixer outlet pipe 128.

FIG. 12B exemplarily illustrates an enlarged bottom perspective view of the portion P shown in FIG. 11. The ends 126*a* and 127*a* of the first outlet pipe 126 and 127 of the first elongate reservoir 124 and the second elongate reservoir 125 respectively contacts the lower surface 129*b* of the flexible disc 129. The second outlet pipes 134 and 135 fuse to form a mixer outlet pipe 128 below the lower surface 129*b* of the flexible disc 129. The end 128*a* of the mixer outlet pipe 128 contacts the lower surface 129*b* of the flexible disc 129. FIG. 12C exemplarily illustrates an enlarged perspective view of the portion P shown in FIG. 11, with a portion 101*i* of the reservoir handle 101 slidably engaged in the sleeve 133 of the flexible disc 129. The portion 101*i* of the reservoir handle 101 slides through the sleeve 133, when the liquid transfer assembly 131 rotates to alternatively connect the hole 132 of the flexible disc 129 to the first outlet pipe 126 of the first elongate reservoir 124, the first outlet pipe 127 of the second elongate reservoir 125, or the mixer outlet pipe 128 to extrude the dispensing liquids 1101 and 1102 from the elongate reservoirs 124 and 125 respectively. The extruded dispensing liquids 1101 and 1102 are dispensed through the outlet holes 101*g* and 101*h* defined proximal to the first end 101*a* and the second end 101*b* of the reservoir handle 101 respectively as exemplarily illustrated in FIG. 11.

Figure 13:
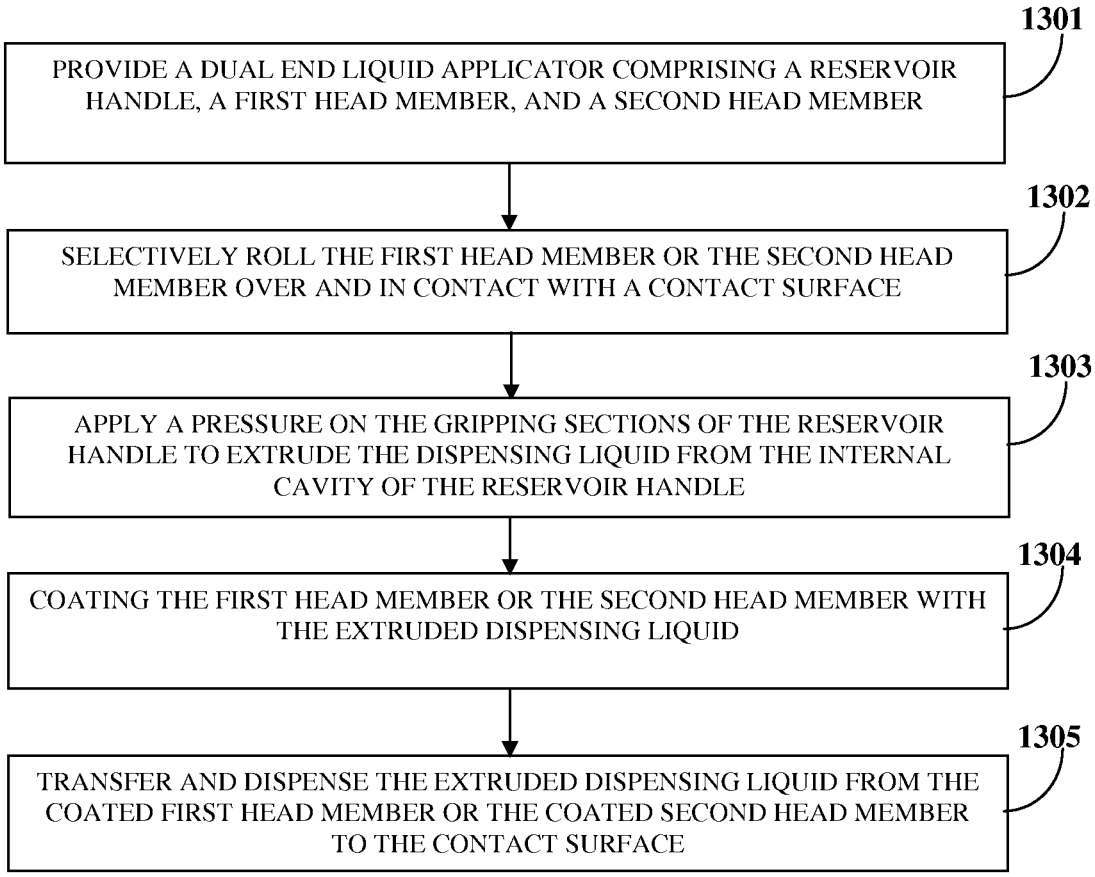
FIG. 13 exemplarily illustrates a method for applying a dispensing liquid to a contact surface.

FIG. 13 exemplarily illustrates a method for applying a dispensing liquid 1001 exemplarily illustrated in FIG. 10A, to a contact surface 901 or 902 exemplarily illustrated in FIGS. 9A-9B. The dual end liquid applicator 100 comprising the reservoir handle 101 with the gripping sections 111 defined at the opposing sides 101*c* and 101*d* of the reservoir handle 101, the first head member 102, and the second head member 103 as disclosed in the detailed description of FIGS. 1-10E is provided 1301. A user selectively rolls 1302 the first head member 102 or the second head member 103 over and in contact with the contact surface 901 or 902, for example, by opening the flippable lid 107 or 109 with a single hand and holding the dual end liquid applicator 100 in a substantially vertical direction. The user applies 1303 pressure on the gripping sections 111 of the reservoir handle 101 to extrude the dispensing liquid 1001 from the internal cavity 114 of the reservoir handle 101 through the first opening 101*e* defined at the first end 101*a* of the reservoir handle 101 or the second opening 101*f* defined at the second end 101*b* of the reservoir handle 101 as exemplarily illustrated in FIG. 2 and FIGS. 8A-8C, thereby coating 1304 the first head member 102 or the second head member 103 with the extruded dispensing liquid 1001. The extruded dispensing liquid 1001 is then transferred and dispensed 1305 from the coated first head member 102 or the coated second head member 103 to a contact surface 901 or 902 as exemplarily illustrated in FIG. 10C and FIG. 10E.

Figure 14:
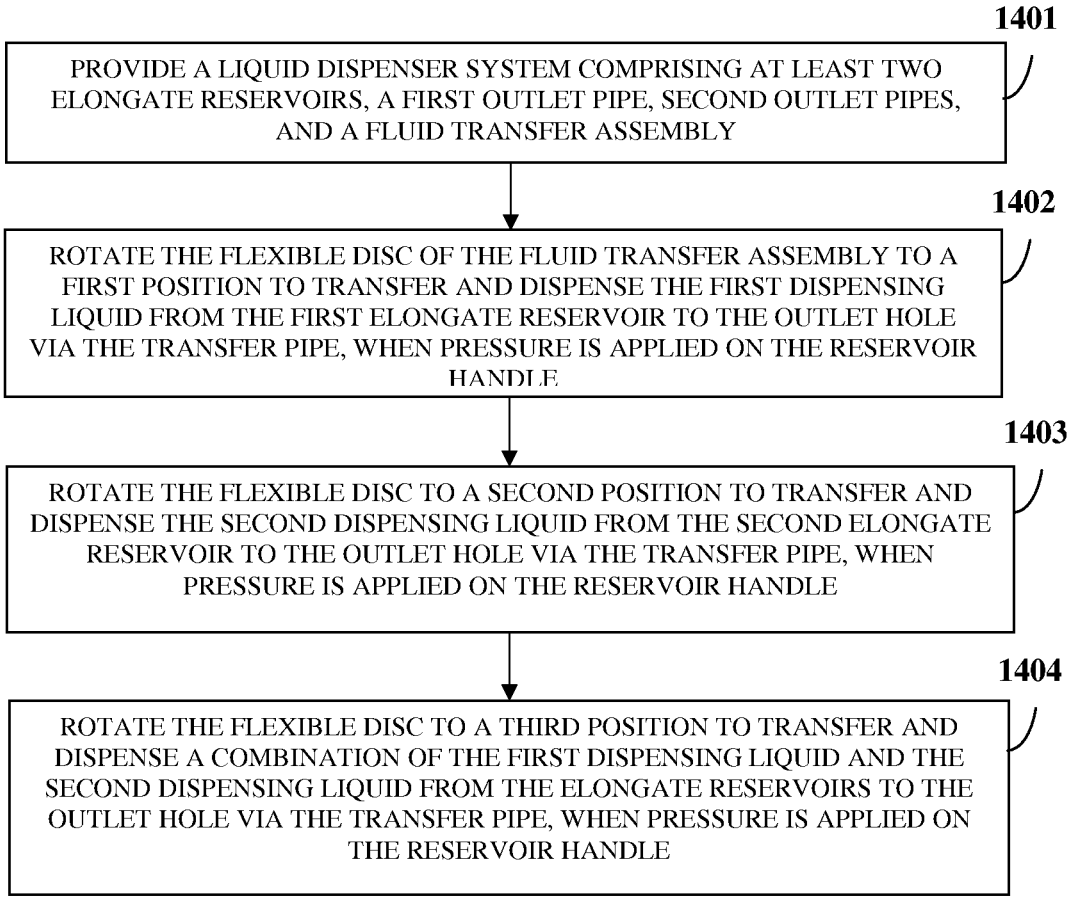
FIG. 14 exemplarily illustrates a method for applying a first dispensing liquid, a second dispensing liquid, or a combination thereof to a contact surface.

FIG. 14 exemplarily illustrates a method for applying a first dispensing liquid 1101, a second dispensing liquid 1102, or a combination thereof exemplarily illustrated in FIG. 11 to a contact surface 901 or 902 exemplarily illustrated in FIGS. 9A-9B. In an embodiment, the method disclosed herein comprises providing 1401 the liquid dispenser system 123 operably connected in the internal cavity 114 of the reservoir handle 101 as disclosed in the detailed description of FIG. 11 and FIGS. 12A-12C. The liquid dispenser system 123 comprises at least two elongate reservoirs 124 and 125, the first outlet pipe 126 for the first elongate reservoir 124, the first outlet pipe 127 for the second elongate reservoir 125, the second outlet pipes 134 and 135, and the liquid transfer assembly 131 as exemplarily illustrated in FIG. 11 and FIGS. 12A-12C.

If a user wishes to apply the first dispensing liquid 1101 from the first elongate reservoir 124, for example, to a contact surface 901 exemplarily illustrated in FIG. 9A, the user rotates 1402 the flexible disc 129 of the liquid transfer assembly 131 to a first position for connecting the hole 132 of the flexible disc 129 proximal to the inner circumference 129*c* of the flexible disc 129 to the first outlet pipe 126 of the first elongate reservoir 124. The user then applies pressure on the reservoir handle 101 to transfer and dispense the first dispensing liquid 1101 from the first elongate reservoir 124 to the outlet hole 101*g* proximal to the first end 101*a* of the reservoir handle 101 via the transfer pipe 130. In the first position, the first outlet pipe 127 of the second elongate reservoir 125 and the mixer outlet pipe 128 are closed by the lower surface 129*b* of the flexible disc 129. When the user rolls the roller ball 104 of the roller ball assembly 106 over the contact surface 901 as exemplarily illustrated in FIG. 9A and FIG. 10C, the first dispensing liquid 1101 transferred and dispensed through the outlet hole 101*g*, coats the roller ball 104 and dispenses onto the contact surface 901.

If the user wishes to apply the second dispensing liquid 1102 from the second elongate reservoir 125, for example, to a contact surface 902 exemplarily illustrated in FIG. 9B, the user rotates 1403 the flexible disc 129 to a second position for connecting the hole 132 of the flexible disc 129 to the first outlet pipe 127 of the second elongate reservoir 125. The user then applies pressure on the reservoir handle 101 to transfer and dispense the second dispensing liquid 1102 from the second elongate reservoir 125 to the outlet hole 101*h* proximal to the second end 101*b* of the reservoir handle 101 via the transfer pipe 130. In the second position, the first outlet pipe 126 of the first elongate reservoir 124 and the mixer outlet pipe 128 are closed by the lower surface 129*b* of the flexible disc 129. When the user rolls the elongated roller 115 of the elongate roller assembly 117 over the contact surface 902 as exemplarily illustrated in FIG. 9B and FIG. 10E, the second dispensing liquid 1102 transferred and dispensed through the outlet hole 101*h*, coats the elongated roller 115 and dispenses onto the contact surface 902.

If the user wishes to apply a combination of the first dispensing liquid 1101 and the second dispensing liquid 1102 from both the elongate reservoirs 124 and 125 to a contact surface 901 or 902 exemplarily illustrated in FIGS. 9A-9B, the user rotates 1404 the flexible disc 129 of the liquid transfer assembly 131 to a third position for connecting the hole 132 of the flexible disc 129 to the mixer outlet pipe 128. The user then applies pressure on the reservoir handle 101 to transfer and dispense a combination of the first dispensing liquid 1101 and the second dispensing liquid 1102 from the two elongate reservoirs 124 and 125 to either of the outlet holes 101*g* and 101*h* proximal to the first end 101*a* and the second end 101*b* of the reservoir handle 101 respectively via the transfer pipe 130. In the third position, the first outlet pipe 126 of the first elongate reservoir 124 and the first outlet pipe 127 of the second elongate reservoir 125 are closed by the lower surface 129*b* of the flexible disc 129. When the user rolls the roller ball 104 of the roller ball assembly 106 over the contact surface 901, the combination of the first dispensing liquid 1101 and the second dispensing liquid 1102, transferred and dispensed through the outlet hole 101*g*, coats the roller ball 104 and dispenses onto the contact surface 901. Similarly, when the user rolls the elongated roller 115 of the elongate roller assembly 117 over the contact surface 902, the combination of the first dispensing liquid 1101 and the second dispensing liquid 1102, transferred and dispensed through the outlet hole 101*h*, coats the elongated roller 115 of the elongate roller assembly 117 and dispenses onto the contact surface 902.

The dual end liquid applicator 100 disclosed herein can be operated single handed, and can be opened and closed at either of the ends 101*a* and 101*b* for application on a larger or smaller surface area. The dual end liquid applicator 100 can be used in medical applications, for example, in emergency medical situations, or for injured military personnel with limited medical support on and off the field, for dispensing muscle or joint pain relief liquids, personal lubricants, pregnancy skin care creams, body massage oils, sunscreen, etc., for bug bites treatment, for skin care more particularly with burns, etc. The dual end liquid applicator 100 being a single handed applicator facilitates rapid and efficient dispensing of medical lotions, antiseptics, etc., during medical and military emergencies. The single hand operated dual end liquid applicator 100 further finds application in the medical field, for example, for facilitating deft maneuvers in hospital and research environments as well as in sub-optimal conditions. Environmental applications of the dual end liquid applicator 100 comprise, for example, treatment of burn victims, field work, and natural disaster stations. Architectural applications of the dual end liquid applicator 100 comprise, for example, modeling, dioramas, etc. Craft work applications of the dual end liquid applicator 100 comprise, for example, glue or paint applications on paper or allied surfaces, in the field of painting and education where gripping sections 111, for example, wide grips, of the dual end liquid applicator 100 are good for hands of a smaller size in an educational application. The cosmetic applications of the dual end liquid applicator 100 comprise, for example, dispensing lotions such as sunscreen, moisturizer, shaving cream for male users and female users, topical skin numbing agents, etc.

The dual end liquid applicator 100 disclosed herein is lightweight, durable, provides an ergonomic grip to the user, and enhances delivery and application of the dispensing liquid 1001, without wastage of guessed amounts of the dispensing liquid 1001 typically caused by applying the dispensing liquid 1001 to the user's hands prior to application of the dispensing liquid 1001 to the user's contact surface 901 or 902. The dual end liquid applicator 100 disclosed herein allows direct application of the dispensing liquid 1001 to a particular site on the contact surface 901 or 902 for an intended purpose, thereby preventing wastage of the dispensing liquid 1001 and allowing uninterrupted activity. The dual end liquid applicator 100 disclosed herein is used in multiple applications, for example, medical applications, cleansing applications, personal lubrication, fine art applications, first aid applications, cosmetic applications, culinary applications, and interactive applications. The medical applications of the dual end liquid applicator 100 disclosed herein comprise, for example, application of the dispensing liquid 1001 on sensitive contact surfaces 901 and 902, new body tissues, burns, etc., and for providing controlled doses of liquid medicines. The cleansing applications of the dual end liquid applicator 100 disclosed herein comprise, for example, oral care and animal care. The fine art applications of the dual end liquid applicator 100 disclosed herein comprise, for example, painting and decoration. The first aid applications of the dual end liquid applicator 100 disclosed herein comprise, for example, application of sunscreen lotions, body ointments, travel products, etc. The cosmetic applications of the dual end liquid applicator 100 disclosed herein comprise, for example, application of foundation liquids, make-up, shaving cream, etc. The culinary applications of the dual end liquid applicator 100 disclosed herein comprise, for example, baking and cake decoration. The interactive applications of the dual end liquid applicator 100 disclosed herein comprise, for example, arts, crafts, dexterity activities, educational supply, etc.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials, and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

I claim:

1. A dual end liquid applicator comprising:

a reservoir handle comprising a first end and a second end opposing said first end, wherein said reservoir handle further comprises a first opening defined at said first end and a second opening defined at said second end, and wherein said reservoir handle further comprises an internal cavity configured to store a dispensing liquid;

a first head member operably connected at said first opening defined at said first end of said reservoir handle, wherein said first head member is configured to transfer and dispense said dispensing liquid from said internal cavity of said reservoir handle through said first opening defined at said first end of said reservoir handle to said contact surface when said first head member is rolled over and in contact with said contact surface;

a first head member operably connected at said first opening defined at said first end of said reservoir handle, wherein said first head member is configured to transfer and dispense said dispensing liquid from said internal cavity of said reservoir handle through said first opening defined at said first end of said reservoir handle to said contact surface when said first head member is rolled over and in contact with said contact surface;

a second head member operably connected at said second opening defined at said second end of said reservoir handle, said second head member configured to transfer and dispense said dispensing liquid from said internal cavity of said reservoir handle through said second opening defined at said second end of said reservoir handle to said contact surface, when said second head member is rolled over and in contact with said contact surface;

said second head member is configured to house an elongate roller assembly, said elongate roller assembly configured to transfer and dispense said dispensing liquid from said internal cavity of said reservoir handle through said second opening defined at said second end of said reservoir handle to said contact surface, when said second head member is rolled over and in contact with said contact surface; and said first head member configured to house a roller ball assembly, wherein said roller ball assembly is configured to transfer and dispense said dispensing liquid from said internal cavity of said reservoir handle through said first opening defined at said first end of said reservoir handle to said contact surface, when said first head member is rolled over and in contact with said contact surface.

2. The dual end liquid applicator of claim 1, wherein said roller ball assembly comprises:

a roller ball rollably positioned within a hemispherical housing defined proximal to said first opening at said first end of said reservoir handle, wherein said roller ball is configured to contact and to be coated with said dispensing liquid stored in said internal cavity of said reservoir handle and to roll within said hemispherical housing, when said roller ball is rolled over and in contact with said contact surface; and a ball lock ring attached to said first end of said reservoir handle, wherein said ball lock ring is configured to slidably lock said roller ball within said hemispherical housing.

3. A dual end liquid applicator comprising;

a reservoir handle comprising a first end and a second end opposing said first end, said reservoir handle further comprising a first opening defined at said first end, and a second opening defined at said second end, said reservoir handle defining an internal cavity configured to store a dispensing liquid;

a first head member operably connected at said first opening defined at said first end of said reservoir handle, said first head member configured to transfer and dispense said dispensing liquid from said internal cavity of said reservoir handle through said first opening defined at said first end of said reservoir handle to a contact surface, when said first head member is rolled over and in contact with said contact surface;

a second head member operably connected at said second opening defined at said second end of said reservoir handle, said second head member configured to transfer and dispense said dispensing liquid from said internal cavity of said reservoir handle through said second opening defined at said second end of said reservoir handle to said contact surface, when said second head member is rolled over and in contact with said contact surface; and a liquid dispenser system operably connected in said internal cavity of said reservoir handle, wherein said liquid dispenser system comprises:

at least two elongate reservoirs positioned substantially parallel to each other within said internal cavity of said reservoir handle, wherein a first of said at least two elongate reservoirs is configured to store a first said dispensing liquid, and wherein a second of said at least two elongate reservoirs is configured to store a second said dispensing liquid;

a first outlet pipe extending from each of opposing ends of each of said at least two elongate reservoirs, wherein said first outlet pipe is in fluid communication with said each of said at least two elongate reservoirs, and wherein said first outlet pipe of said first of said at least two elongate reservoirs is configured to transfer and dispense said first said dispensing liquid from said first of said at least two elongate reservoirs to an outlet hole proximal to each of said first end and said second end of said reservoir handle, and wherein said first outlet pipe of said second of said at least two elongate reservoirs is configured to transfer and dispense said second said dispensing liquid from said second of said at least two elongate reservoirs to said outlet hole proximal to said each of said first end and said second end of said reservoir handle;

second outlet pipes extending from said opposing ends of said at least two elongate reservoirs, wherein said second outlet pipes are in fluid communication with said at least two elongate reservoirs and are fused to create a mixer outlet pipe, wherein said mixer outlet pipe is configured to transfer and dispense a combination of said first said dispensing liquid and said second said dispensing liquid from said at least two elongate reservoirs to said outlet hole proximal to said each of said first end and said second end of said reservoir handle;

a liquid transfer assembly operably connected to said each of said first end and said second end of said reservoir handle, wherein said liquid transfer assembly comprises a flexible disc defining a hole proximal to an inner circumference of said flexible disc and in fluid communication with said outlet hole, and a transfer pipe fixedly attached to said hole on an upper surface of said flexible disc; and said flexible disc rotatable to alternatively connect said hole of said flexible disc to one of said first outlet pipe of said each of said at least two elongate reservoirs and said mixer outlet pipe, and transfer and dispense one of said first said dispensing liquid, said second said dispensing liquid, and a combination thereof to one of said outlet hole proximal to said first end of said reservoir handle and said outlet hole proximal to said second end of said reservoir handle via said transfer pipe, when pressure is applied on said reservoir handle.

4. The dual end liquid applicator of claim 3, wherein said liquid transfer assembly further comprises a sleeve defined along said inner circumference of said flexible disc, wherein said sleeve is configured to slidably engage with a portion of said reservoir handle internally for enabling rotation of said flexible disc.

5. A liquid applicator comprising:

a reservoir handle comprising a first end and a second end opposing said first end, said reservoir handle further comprising a first opening defined at said first end, said reservoir handle defining an internal cavity configured to store a dispensing liquid;

a first head member operably connected at said first opening defined at said first end of said reservoir handle, said first head member configured to transfer and dispense said dispensing liquid from said internal cavity of said reservoir handle through said first opening defined at said first end of said reservoir handle to a contact surface, when said first head member is rolled over and in contact with said contact surface; and a liquid dispenser system operably connected in said internal cavity of said reservoir handle, wherein said liquid dispenser system comprises:

at least two elongate reservoirs positioned substantially parallel to each other within said internal cavity of said reservoir handle, wherein a first of said at least two elongate reservoirs is configured to store a first said dispensing liquid, and wherein a second of said at least two elongate reservoirs is configured to store a second said dispensing liquid;

a first outlet pipe extending from each of opposing ends of each of said at least two elongate reservoirs, wherein said first outlet pipe is in fluid communication with said each of said at least two elongate reservoirs, and wherein said first outlet pipe of said first of said at least two elongate reservoirs is configured to transfer and dispense said first said dispensing liquid from said first of said at least two elongate reservoirs to an outlet hole proximal to said first end of said reservoir handle, and wherein said first outlet pipe of said second of said at least two elongate reservoirs is configured to transfer and dispense said second said dispensing liquid from said second of said at least two elongate reservoirs to said outlet hole;

second outlet pipes extending from said opposing ends of said at least two elongate reservoirs, wherein said second outlet pipes are in fluid communication with said at least two elongate reservoirs and are fused to create a mixer outlet pipe, wherein said mixer outlet pipe is configured to transfer and dispense a combination of said first said dispensing liquid and said second said dispensing liquid from said at least two elongate reservoirs to said outlet hole;

a liquid transfer assembly operably connected to said first end of said reservoir handle, wherein said liquid transfer assembly comprises a flexible disc defining a hole proximal to an inner circumference of said flexible disc and in fluid communication with said outlet hole, and a transfer pipe fixedly attached to said hole on an upper surface of said flexible disc; and said flexible disc rotatable to alternatively connect said hole of said flexible disc to one of said first outlet pipe of said each of said at least two elongate reservoirs and said mixer outlet pipe, and transfer and dispense one of said first said dispensing liquid, said second said dispensing liquid, and a combination thereof to said outlet hole via said transfer pipe, when pressure is applied on said reservoir handle.

6. A liquid applicator comprising:

a reservoir handle comprising a first end and a second end opposing said first end, said reservoir handle further comprising an opening defined at said second end, said reservoir handle defining an internal cavity configured to store a dispensing liquid;

a head member operably connected at said opening defined at said second end of said reservoir handle, said head member configured to transfer and dispense said dispensing liquid from said internal cavity of said reservoir handle through said opening defined at said second end of said reservoir handle to said contact surface, when said head member is rolled over and in contact with said contact surface; and a liquid dispenser system operably connected in said internal cavity of said reservoir handle, wherein said liquid dispenser system comprises:

at least two elongate reservoirs positioned substantially parallel to each other within said internal cavity of said reservoir handle, wherein a first of said at least two elongate reservoirs is configured to store a first said dispensing liquid, and wherein a second of said at least two elongate reservoirs is configured to store a second said dispensing liquid;

a first outlet pipe extending from each of opposing ends of each of said at least two elongate reservoirs, wherein said first outlet pipe is in fluid communication with said each of said at least two elongate reservoirs, and wherein said first outlet pipe of said first of said at least two elongate reservoirs is configured to transfer and dispense said first said dispensing liquid from said first of said at least two elongate reservoirs to an outlet hole proximal to said second end of said reservoir handle, and wherein said first outlet pipe of said second of said at least two elongate reservoirs is configured to transfer and dispense said second said dispensing liquid from said second of said at least two elongate reservoirs to said outlet hole;

second outlet pipes extending from said opposing ends of said at least two elongate reservoirs, wherein said second outlet pipes are in fluid communication with said at least two elongate reservoirs and are fused to create a mixer outlet pipe, wherein said mixer outlet pipe is configured to transfer and dispense a combination of said first said dispensing liquid and said second said dispensing liquid from said at least two elongate reservoirs to said outlet hole;

a liquid transfer assembly operably connected to said second end of said reservoir handle, wherein said liquid transfer assembly comprises a flexible disc defining a hole proximal to an inner circumference of said flexible disc and in fluid communication with said outlet hole, and a transfer pipe fixedly attached to said hole on an upper surface of said flexible disc; and said flexible disc rotatable to alternatively connect said hole of said flexible disc to one of said first outlet pipe of said each of said at least two elongate reservoirs and said mixer outlet pipe, and transfer and dispense one of said first said dispensing liquid, said second said dispensing liquid, and a combination thereof to said outlet hole via said transfer pipe, when pressure is applied on said reservoir handle.

* * * * *